US005845711A

United States Patent [19]

Connell et al.

[11] Patent Number: 5,845,711

[45] Date of Patent: Dec. 8, 1998

[54] COILED TUBING APPARATUS

[75] Inventors: Michael L. Connell; James Craig Tucker, both of Duncan, Okla.; Pat Murphy White, Carrollton; James Robert Longbottom, Whitesboro, both of Tex.; Paul L. Browne, Dundee, Scotland; Michael Dennis Bullock, The Woodlands, Tex.; Karluf Hagen, Randaberg, Norway

[73] Assignee: Halliburton Company, Duncan, Okla.

[21] Appl. No.: 459,028

[22] Filed: Jun. 2, 1995

[51] Int. Cl.[6] ..... E21B 19/22

[52] U.S. Cl. ..... 166/384; 166/77.2

[58] Field of Search ..... 166/384, 386, 166/77.2, 77.3, 120, 319, 320, 321

[56] References Cited

U.S. PATENT DOCUMENTS

| | | | |
|---|---|---|---|
| 5,117,906 | 6/1992 | Giusti, Jr. et al. | 166/120 |
| 5,180,012 | 1/1993 | Crawford | 166/386 X |
| 5,305,828 | 4/1994 | White et al. | 166/120 |
| 5,343,963 | 9/1994 | Bouldin et al. | 166/65.1 X |
| 5,411,085 | 5/1995 | Moore et al. | 166/77.2 X |

OTHER PUBLICATIONS

Tailby, Roger J., Pumpdown Assistance Extends Coiled Tubing Reach, World Oil, Offshore '92, Jul. 1992.

Maurer Engineering Inc., DEA–44/DEA–67 International Technology Forum, Sheraton Grand Hotel, Houston, Texas, Sep. 29, 1993–Oct. 1, 1993.

*Primary Examiner*—William P Neuder

*Attorney, Agent, or Firm*—Stephen R. Christian; David A. Rose

[57] ABSTRACT

The apparatus and method for injecting coiled tubing downhole includes a connector member disposed on the end of the coiled tubing and supporting a downhole tool. A packer member is releasably connected to the connector member. The packer member includes a pack-off element and slips for releasably engaging the outer pipe string through which the coiled tubing is being injected. Seals are provided on the packer member for engaging the outer circumferential surface of the coiled tubing. A fluid passageway extends through the connector member for communicating the packer member with the coiled tubing. Fluid pressure is applied through the flow bore of the coiled tubing. The fluid pressure is applied through the fluid passageway to actuate an actuator member in the packer member to set the pack-off element and slips. Thus, upon actuating the packer member, the annulus formed by the coiled tubing and outer pipe string is closed. Fluid is then applied from the surface into the annulus to support and stiffen the coiled tubing as the injector applies additional force to further inject the coiled tubing downhole. Upon the setting of the packer member, the packer member is also released from the connector member so that the connector member and downhole tool disposed on the end of the coiled tubing may be further injected downhole. The connector member includes a dual check valve in the fluid passageway which allows fluid passage to actuate the packer member and closes the fluid passage after the connector member is disconnected from the packer member. The connector member may also include a valve member which allows circulation down the flow bore of the coiled tubing. The packer member includes a valve for the passage of well fluids between the packer member and coiled tubing.

32 Claims, 23 Drawing Sheets

COILED TUBING APPARATUS

BACKGROUND OF THE INVENTION

The present invention relates to a method and apparatus for injecting downhole an oilfield tool mounted on the end of a coiled tubing string, and more particularly to a pack-off, pack-off connector, and valve mounted on the end of the coiled tubing string for pressuring the annulus around the coiled tubing to prevent helical buckling of the coiled tubing which inhibits the injection of the coiled tubing downhole particularly in deviated or horizontal wells.

Coiled tubing is being utilized in the oilfield for the purpose of running downhole oilfield tools into the borehole of a well. In particular, coiled tubing is being used in a deviated or horizontal well where the borehole has one or more sections which deviate substantially from the vertical and may include a horizontal section of the borehole several thousand feet long. In vertical wells, pipe strings may be maintained in tension due to the weight of the string caused by the force of gravity. However, in horizontal wells, the advantage of gravity may not be relied upon to assist in the running of the pipe string downhole and often the string must be in compression as the string is forced downhole from the surface such as by an injector in the case of coiled tubing.

In extended reach wells or horizontal wells, many applications involve coiled tubing having an electric line extending through the flow bore of the coiled tubing. Such applications are commonly used for logging a well where a logging tool is disposed on the end of the coiled tubing. After the logging tool has been injected downhole into the bottom of the well, the hole is logged as the logging tool is drawn out of the well along the length of the borehole. Often, it is desirable to flow the well while logging.

FIG. 2 illustrates the problems of injecting coiled tubing into a horizontal well. An injector head at the surface includes a pair of opposed injector chains which unreel coiled pipe from a drum over a guide arch. The uncoiled tubing is injected through a lubricator head and down through a larger diameter pipe string. As the coiled tubing passes down the vertical section of the bore and into the radius section, the coiled tubing engages the walls of the outer pipe string which creates drag forces on the coiled tubing thereby inhibiting the insertion of the coiled tubing into the well. Particularly, as the coiled tubing enters the horizontal section of the wellbore, substantial drag forces are placed on the coiled tubing requiring increased force from the injector head at the surface to force the coiled tubing into the well. Other obstructions in the well such as sand bridges may also inhibit the injection of the coiled tubing into the well. As the drag forces on the coiled tubing increase, there is a tendency of the coiled tubing to buckle in a helical fashion. This buckling will occur throughout the pipe string extending into the well and will increase the friction or drag between the coiled tubing and the inner cylindrical wall of the outer pipe string. Further, the force of the injector head on the coiled tubing is no longer applied in a linear manner because of the helical buckling of the coiled tubing. The drag forces on the coiled tubing will eventually become so great that a helical lock up of the coiled tubing will occur prohibiting further injection of the coiled tubing into the well.

The drag on the coiled tubing accumulates exponentially from the lower end of the coiled tubing as the lower end of the coiled tubing requires additional force, i.e. compression, and will not slide within the outer pipe string. This compression acts on the helix formed in the coiled tubing to create additional drag. More compression then is required to overcome the drag which in turn shortens the helix, thus causing more drag. Further, a bigger diameter helix, i.e., a tighter helix, will convert more of the compression to wall force and hence drag. There is a shorter accumulation of drag where the helix and the coiled tubing has a smaller diameter and is longer. However, when the exponential drag becomes great, lock up of the coiled tubing will occur.

The helix and the coiled tubing starts at the lower end of the coiled tubing. The wall forces on the outer pipe string then begin to take some of the injection force due to the residual bend of the coiled tubing. As more injection force is applied, there is a greater compression on the coiled tubing and thus a greater wall force thus requiring even greater injection force to inject the tubing. At the bottom of the coiled tubing, the drag becomes almost sufficient to hold the injection force transmitted through the coiled tubing to that point. Once the drag can sustain the injection force, compression accumulates and the coiled tubing locks up. The coiled tubing can lock up from the bottom of the well to the top of the well but with a long, high angle, larger radius section in the wellbore, the lock up of the coiled tubing will occur at the heel of the radius before it occurs at the end of the horizontal section of the well.

One prior art method of reducing the helical buckling of the coiled tubing is shown in FIG. 3. An outer nipple is disposed in the outer pipe string and is located downhole in the well at a predetermined location. The outer nipple includes a profile for receiving an inner nipple mounted on the coiled tubing at a predetermined distance from the end of the coiled tubing. The inner nipple slidingly and sealingly receives the coiled tubing such that upon the inner nipple being seated in the outer nipple profile, the coiled tubing may continue to pass through the inner nipple with the inner nipple sealingly engaging the coiled tubing. Upon the inner nipple being received by the outer nipple profile, an upper annulus is formed above the inner and outer nipples between the coiled tubing and outer pipe string. This annulus is pressurized so as to provide support around the coiled tubing extending from the surface down to the nipples and prevents any substantial helical buckling to that portion of the coiled tubing. This annular pressure around the coiled tubing assists in stiffening that portion of the coiled tubing extending from the nipple to the surface so as to prevent the coiled tubing from dragging against the inner circumferential wall of the outer pipe string and requiring an increase in the injection force on the coiled tubing to overcome the drag. Further, the annular pressure tends to straighten and stiffen the coiled tubing allowing the more efficient transfer of force from the injector head to the coiled tubing. The injector force causes the coiled tubing to pass through the inner nipple so as to permit a greater length of coiled tubing to be injected into the well.

One substantial disadvantage of the above-identified method is that it requires that the outer nipple be a part of the outer pipe string. Thus, the nipple must be run in with the outer pipe string and set at a predetermined location within the borehole. This predetermined location, however, may not be the best location for providing assistance in the injection of the coiled tubing. Further, where coiled tubing is being injected for a work over operation, there is no opportunity for setting the outer nipple into the pipe string since the pipe string has already been installed within the well.

The present invention overcomes the deficiencies of the prior art.

SUMMARY OF THE INVENTION

The apparatus and method of the present invention for injecting coiled tubing downhole includes a valve member disposed on the end of the coiled tubing, a packer member and a connector member for releasably connecting the packer member to the valve member. The packer member includes a pack-off element and slips for releasably engaging the outer pipe string through which the coiled tubing is being injected. Seals are provided on the packer member for engaging the outer circumferential surface of the coiled tubing. A fluid passageway extends through the connector member for communicating the packer member with the valve member.

Fluid flow pressure is applied through the flow bore of the coiled tubing to actuate the valve member to close the flow bore of the coiled tubing at its lower end. Upon closing the valve member, fluid pressure passes through a side opening in the valve member and through the fluid passageway in the connector member to actuate an actuator member in the packer member to set the pack-off element and slips. Thus, upon actuating the pack-off member, the annulus formed by the coiled tubing and outer pipe string is closed. Fluid is then applied from the surface into the annulus to support and stiffen the coiled tubing as the injector applies additional force to further inject the coiled tubing downhole. Upon the setting of the packer member, the packer member is also released from the connector member so that the connector member and valve member disposed on the end of the coiled tubing may be further injected downhole. Typically, a downhole tool assembly is attached to the end of the connector member.

The valve member may be a triple valve when fluid circulation is desired with the downhole tool assembly. The triple valve has a valve housing with a flow bore therethrough. A biasing member is disposed within the flow bore and has one end anchored within the housing. A sphere is also disposed within the flow bore against the other end of the biasing member. An upwardly facing seat and a downwardly facing seat are disposed within the housing with the sphere being disposed between the seats. The biasing member biases the sphere against the downwardly facing seat. The valve acts as a back check for upward fluid flow within the flow bore causing the sphere to seat on the downwardly facing seat. Downward flow through the flow bore will unseat the sphere and allow fluid to flow through the flow bore so long as the fluid pressure does not overcome the biasing member. In this position, the valve member acts as a velocity flow valve. An increase in downward fluid flow so as to overcome the biasing member will cause the sphere to seat in the upwardly facing seat thereby acting as an up check valve. The valve member further includes a third seat on a support sleeve so that in an emergency, a second sphere may be flowed downhole to seat on the third seat to slide a support piston to a non-supporting position to release the valve member from the connector member.

In one embodiment of the invention, the connector member includes a dual check valve in the passageway for allowing fluid flow to set the packer member and, upon release of the connector member from the packer member, closing all flow through the passageway. The dual check valve includes two spheres biased outwardly against two seats by a spring. One of these spheres includes a projection which maintains the outer sphere in the unseated position so long as such projection engages the packer member. Upon disengaging the packer member, the outer sphere with the projection is allowed to seat thereby closing flow through the passageway.

The present invention has the advantage of allowing the pressurization of the annulus at any location within the well without requiring a nipple to have been previously set within the outer pipe string. In particular, the present invention allows coiled tubing to be injected for a work over operation where there is no opportunity for setting an outer nipple within the pipe string.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENTS

Figure 1:
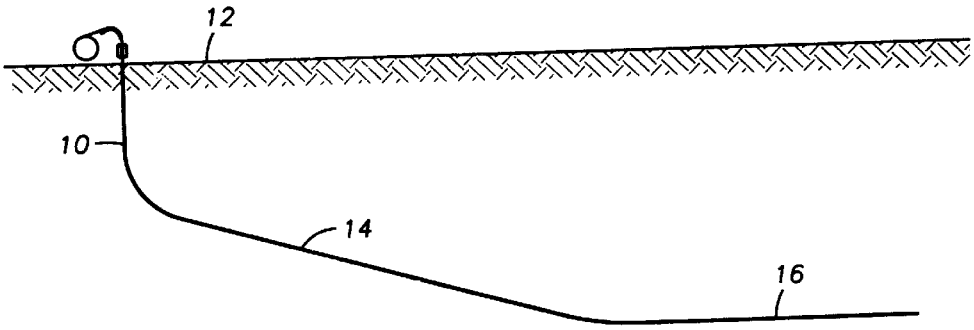
FIG. 1 is a schematic of a horizontal well in which the present invention may be used with coiled tubing.

Referring initially to FIG. 1, there is shown a schematic of an extended reach or horizontal well having a vertical portion 10, radius portion 14 and horizontal portion 16.

Vertical portion 10 extends from the surface 12 in a generally vertical direction into the earth. At the lower end of the vertical portion 10, the well deviates in direction to form an inclined or radius portion 14 extending into the earth at an angle to vertical. At the end of the radius portion 14, there extends a horizontal portion 16 which projects in a generally horizontal direction within the earth. It is no longer unusual for the horizontal portion 16 to extend 12,000 feet or more through the earth.

Figure 2:
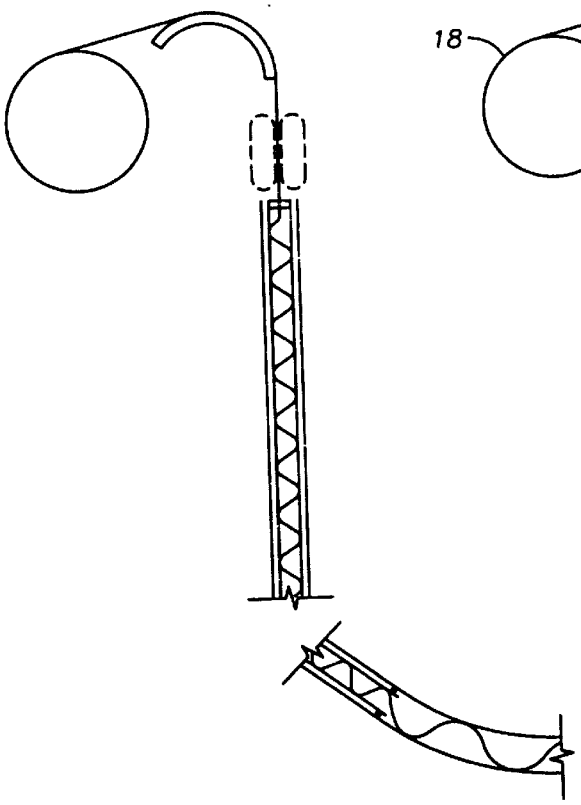
FIG. 2 (PRIOR ART)
FIG. 2 is a schematic of a prior art system using an injector head to inject coiled tubing into a horizontal well.
Figure 3:
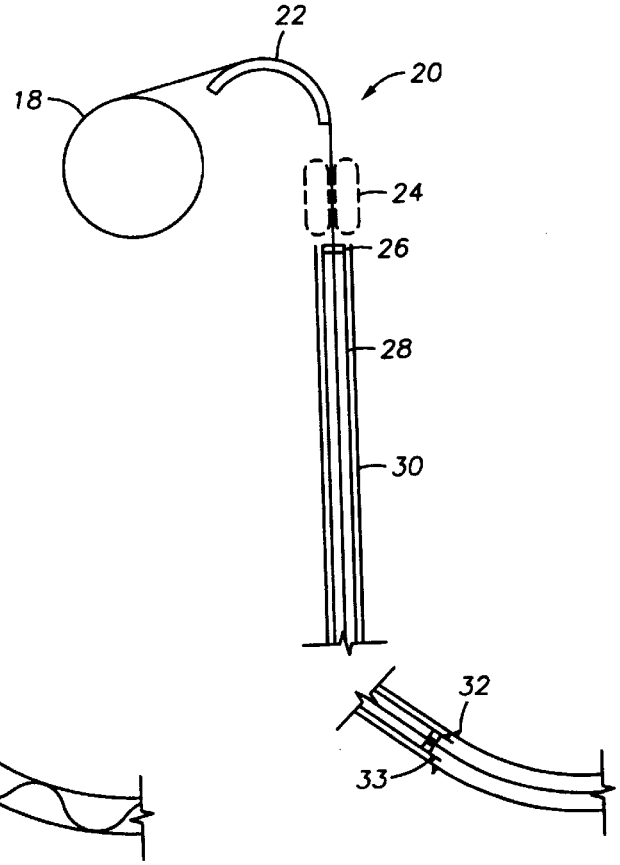
FIG. 3 (PRIOR ART)
FIG. 3 is a schematic of another prior art system where the annulus formed by the coiled tubing and outer pipe string is packed off and the annulus is placed under fluid pressure to stiffen the coiled tubing as it is injected into a horizontal well.

FIGS. 2 and 3 illustrate prior art methods and apparatus for inserting a coiled tubing into a horizontal well such as shown in FIG. 1. Referring particularly to FIG. 3, there is shown schematically a coiled tubing injector 20 which is well known to those skilled in the art. The coiled tubing injector 20 includes a drum 18 onto which is coiled the tubing. The tubing is uncoiled from the drum 18 and is extended over a guide arch 22 which tends to straighten the coiled tubing prior to injection into the well. A pair of opposed injector chains 24 engage opposite sides of the coiled tubing and by frictional engagement force the coiled tubing down through a lubricator head 26 and into an outer pipe string 28 extending into the well. The pipe string 28 is typically suspended within an outer casing string 30 which is cemented downhole such as at 32 near the bottom end of the radius portion 14. Likewise, the pipe string 28 is also cemented within outer casing string 30 adjacent the end of radius portion 14 at 33.

Referring now to FIG. 4, a preferred embodiment of the present invention is shown for supporting a mechanical downhole tool assembly 80 on the lower and 34 of coiled tubing 70. The mechanical downhole tool assembly 80 may be any downhole oilfield tool not requiring an electrical cable extending to the surface 12 and may utilize fluid flow down through the flow bore 38 or coiled tubing 70. The coiled tubing apparatus includes a pack-off apparatus 40, a packer connector 50, and a triple valve 60, all initially disposed on the lower end 34 of coiled tubing 70. The coiled tubing apparatus is shown in the running position in FIG. 4 with the pack-off apparatus 40, packer connector 50, triple valve 60, and downhole tool assembly 80, all suspended on coiled tubing 70 within outer pipe string 28. Coiled tubing 70 and pipe string 28 form an annulus 36 which extends to the surface 12.

In operation, the pack-off apparatus 40 is attached to the packer connector 50 with the packer connector 50, triple valve 60, and downhole tool assembly 80 attached to the end 34 of coiled tubing 70. Upon the coiled tubing beginning to provide substantial resistance to being injected downhole, particularly into horizontal portion 16, pack-off apparatus 40 is actuated hydraulically by closing triple valve 60 and hydraulically setting pack-off apparatus 40. Upon hydraulically setting pack-off apparatus 40, pack-off apparatus 40 packs off with pipe string 28 and is released from packer connector 50. The fluid in annulus 36 is then pressurized to stiffen coiled tubing 70 such that triple valve 60 and the packer connector 50 with downhole tool assembly 80 may be further injected into the well by injector 20.

Pack-off Apparatus

The pack-off apparatus 40 includes a cylindrical body or housing 42. A sleeve type check valve 44 and seal and scraper assembly 46 are disposed on the upper end of housing 42. A packer 48 is disposed around a reduced diameter portion 52 of housing 42 and a disconnect assembly 54 is disposed around the lower end of housing 42.

Figure 11A:
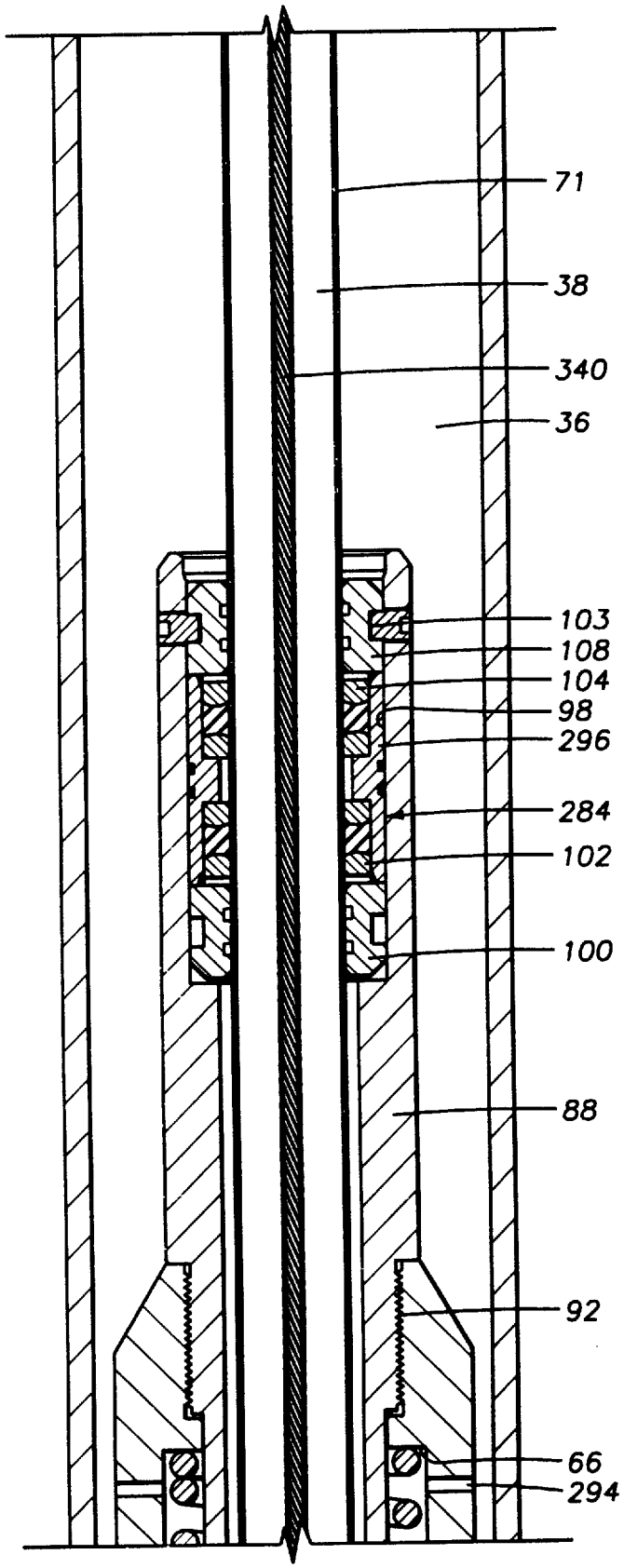
FIGS. 11A–D are a cross-sectional view of an another preferred embodiment of the pack-off apparatus, packer connection and valve member attached to the end of the coiled tubing in the running position.
Figure 11B:
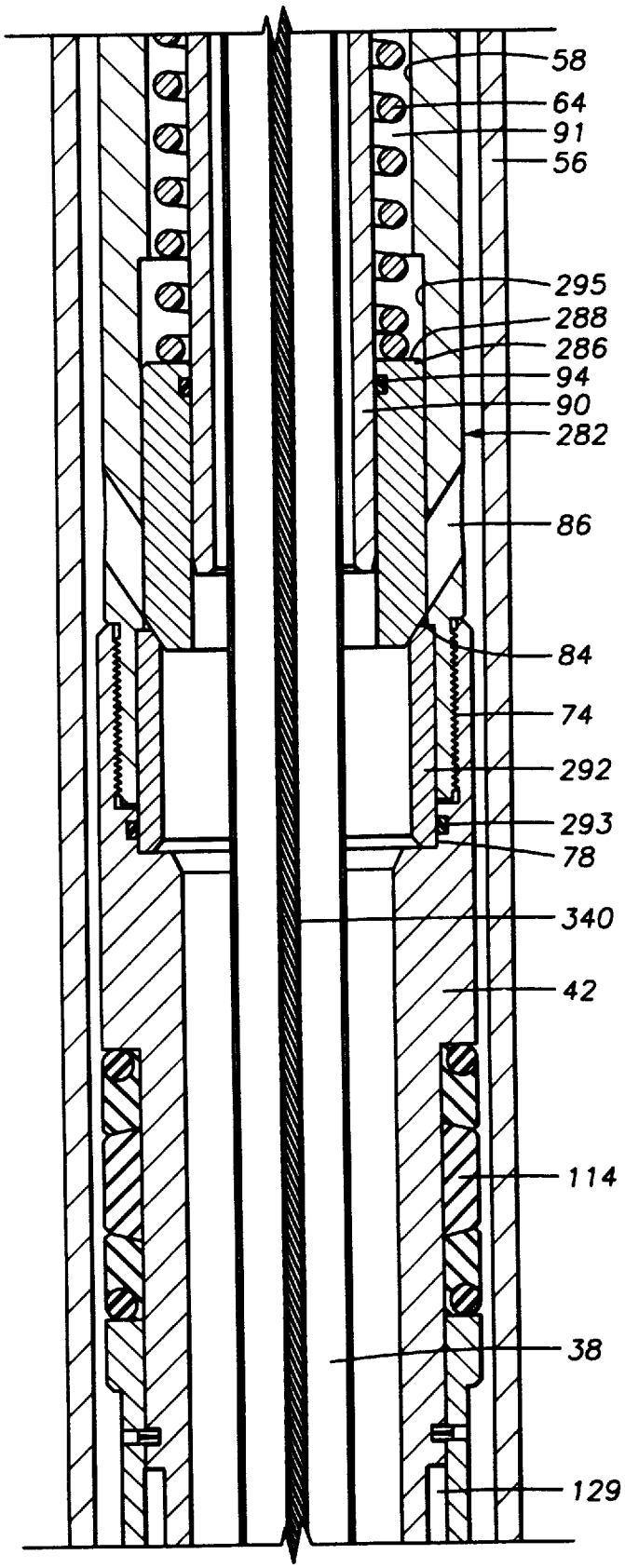
Figure 11C:
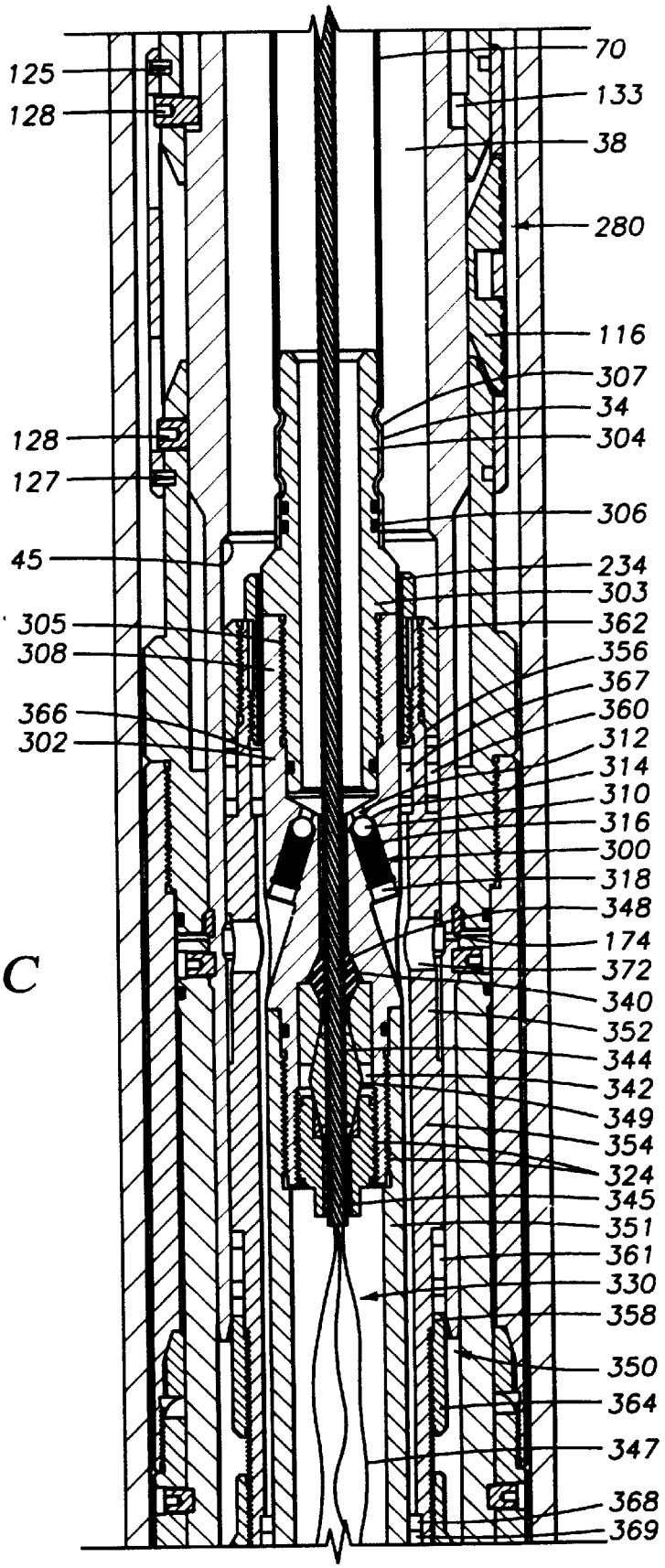
Figure 11D:
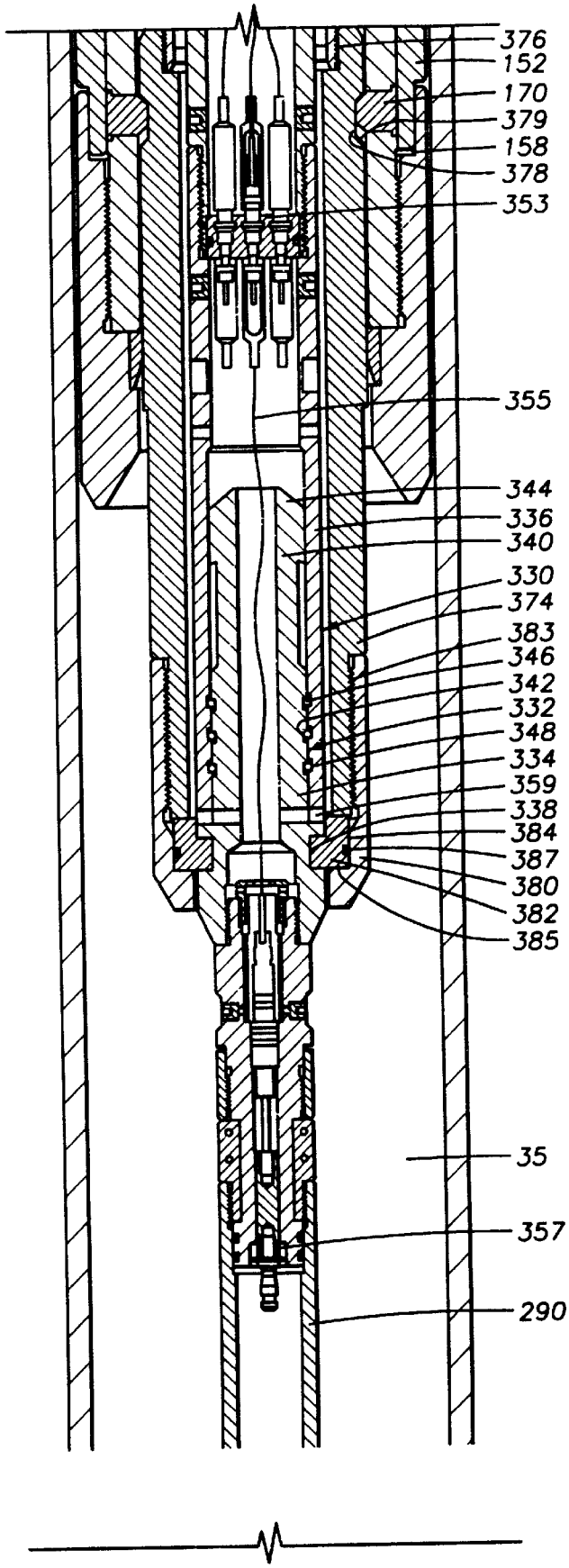

Sleeve type check valve 44 includes an annular valve housing 56 having an inner counterbore 58 for housing a valve sleeve 62 biased downwardly by a spring 64 disposed between a downwardly facing shoulder 66 on valve housing 56 and an upwardly facing annular shoulder 68 formed by upwardly extending skirt 72 on valve sleeve 62. Valve housing 56 threadingly engages the upper end of housing 42 at 74 with housings 42 and 56 being sealed by a sealing member 76. The upper end of housing 42 includes a counterbore 78 housing an annular valve seat 82 for sealingly engaging the conically tapered surface 84 on the downwardly facing end of valve sleeve 62. A port 86 extends at an angle through valve housing 56 for the passage of fluids upon the opening of valve sleeve 62. An alternative preferred embodiment of check valve 44 is shown in FIGS. 11A and 11B.

Seal and scraper assembly 46 includes a mandrel 88 threadingly connected by threads to valve housing 56 at 92. Mandrel 88 includes a downwardly extending annular skirt 90 which with valve housing 56 forms an annular cylinder 91 within which is disposed valve sleeve 62 and spring 64. Valve sleeve 62 includes an energized seal 94 for sealingly engaging skirt 90 of mandrel 88. Mandrel 88 includes an internal counterbore 98 housing a lower scraper ring 100 and a pair of seal rings 102, 104. Mandrel 88 includes an increased diameter counterbore 106 for housing an upper scraper ring 108. Scraper rings 100, 108 and seal rings 102, 104 are maintained in counterbores 98, 106 by fishing neck 110 threadingly disposed on the upper end of mandrel 88 by threads 112. Annular seal rings 102, 104 include a central annular sealing member disposed between a pair of compression rings on each side. A snap ring 105 separates seal rings 102, 104. An alternative preferred embodiment of mandrel 88 and seal and scraper assembly 46 is shown in FIG. 11A.

Packer 48 includes an annular elastomeric pack-off element 114 and a plurality of segments of slips 116 having serrations or teeth 117, both adapted to engage the inner circumferential wall 29 of pipe string 28 upon actuation. Pack-off element 114 includes an annular rib 118 on each end disposed within aligned annular grooves in housing 42 and in upper packer wedge 120. Upper packer wedge 120 and lower packer wedge 122 include cone shaped ramp surfaces for camming engagement with the inclined annular surfaces of slips 116 to force the segments of slips 116 outwardly. Slips 116 are maintained in position by a window sleeve 124 having pairs of windows 126 through which the segments of slips 116 may be cammed outwardly into engagement with pipe string 28. Window sleeve 124 includes shear pins 125, 127 at each end with upper shear pin 125 extending into a groove in upper packer wedge 120 and lower shear pin 127 extending into a groove in lower packer wedge 122. Guide buttons 128 are threaded into tapped bores in upper and lower packer wedges 120 and 122 and extend into longitudinally extending windows 132 in window sleeve 124. Upper packer wedge 120 is initially maintained in position by shear pin 134 and abutting snap ring 136 at its lower end. Likewise, lower packer wedge 122 is maintained in its upper position by shear pins 125, 127 in window sleeve 124. An abutment ring 138 engages the lower end of lower packer wedge 122 for supporting wedge 122 in an upper position. Clearances are provided at each end of window sleeve 124 to allow packer sleeves 120, 122 to move towards each other in a contracted position and bias the segments of slips 116 into their outer and engaged position.

The disconnect assembly 54 includes a cylinder sleeve 140 threaded to the outer surface of lower packer wedge 122 at 142. The lower end of cylinder sleeve 140 includes a threaded box 144 which terminates at an annular shoulder 146 which projects radially inward of cylinder sleeve 140. A shear pin sleeve 148 includes a pin threaded into the box 144. Shear pin sleeve 148 includes a one or more threaded bores receiving start-to-set shear pins 150. The upper terminal end of sleeve 148 abuts internal ratchet slips 149 which have teeth 151 which allow a ratcheting upward movement and lock down in a biting engagement with disconnect piston 164 upon a downward movement. Ratchet slips 149 have an outer tapered surface engaging an inner conical surface of sleeve 140 where upon the downward movement of sleeve 140 with respect to disconnect piston 164 teeth 151 engage disconnect piston 164. A dog support sleeve 152 is threaded at 154 to the lower end of shear pin sleeve 148. Dog support sleeve 152 includes a downwardly projecting reduced outer diameter skirt 156 which, in the running position of the pack-off apparatus 40, is slidingly received within a counterbore 158 in end sub 160. Pack-off housing 42 on the inside and sleeve 140, shear pin sleeve 148, and dog support sleeve 152 on the outside form an annular cylinder 162 for receiving disconnect piston 164. Disconnect piston 164 is threaded to end sub 160 at 166. End sub 160 includes an internal counterbore 167 forming an upwardly facing annular shoulder 169. A C-ring 171 is disposed within counterbore 167 and is adapted for engagement with shoulder 281 as hereinafter described. Disconnect piston 164 also includes a plurality of apertures 168 for receiving dogs 170. As shown in FIG. 4D, dogs 170 are maintained in their radial inward and engaged position by dog support sleeve 152. The upper end of disconnect piston 164 includes a plurality of bores 173 receiving shear pins 172. Shear pins 172 are received within aligned bores in the outer circumference of housing 42. A hydraulic port 174 passes through housing 42 between lower abutment ring 138 and the bores 173 for shear pins 172 and communicates with an inner annular channel 175 in housing 42. Seals 176 are provided in grooves on the inner and outer circumference of disconnect piston 164 to sealingly engage housing 42 and cylinder sleeve 140. Likewise, lower pack-off wedge 122 includes inner and outer grooves housing seal members 178 for sealingly engaging housing 42 and cylinder sleeve 140.

Triple Valve

Figure 4A:
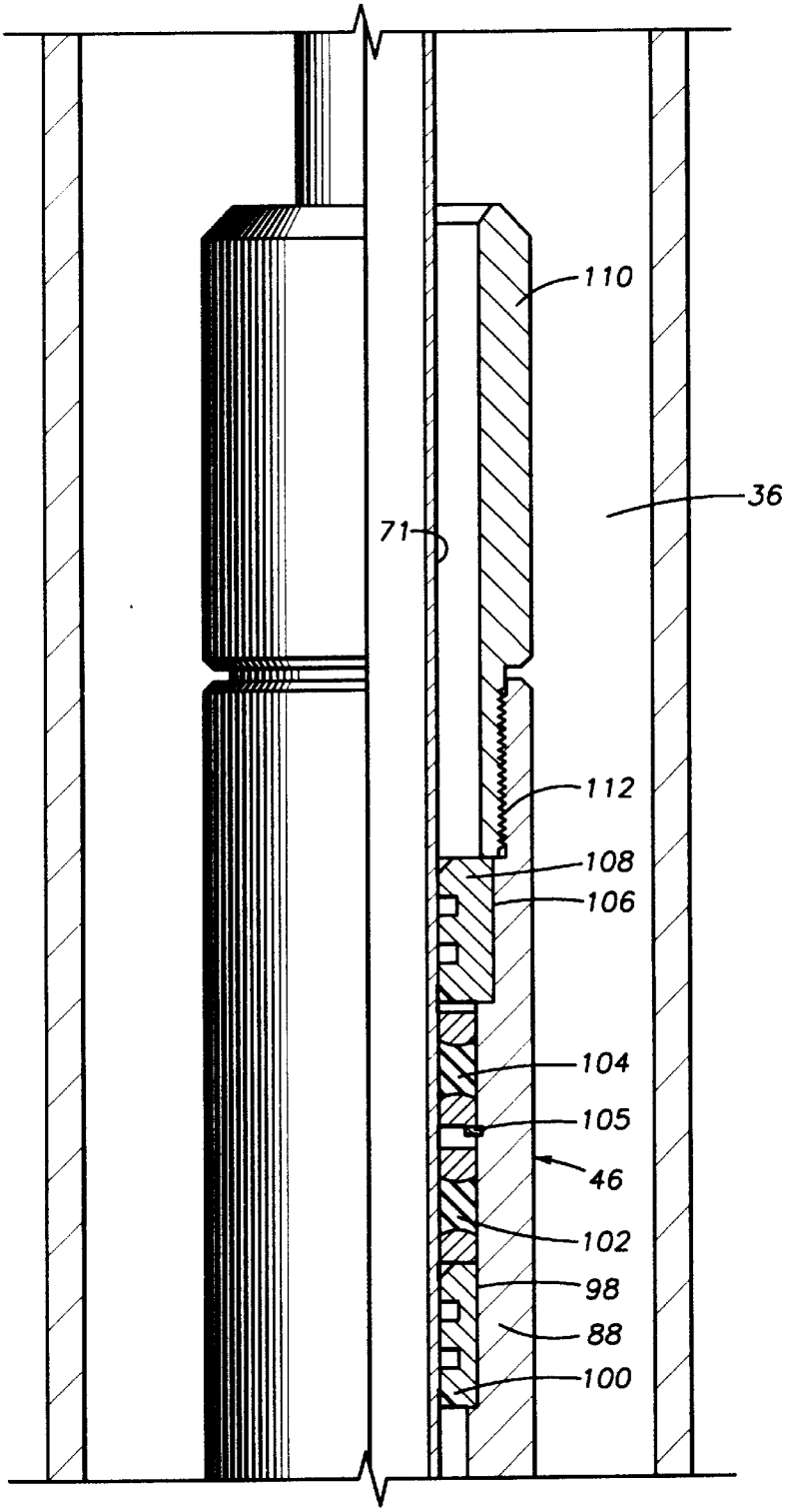
FIGS. 4A–E are a cross-sectional view of the pack-off apparatus, packer connector, and valve member attached to the end of the coiled tubing in the running position.
Figure 4B:
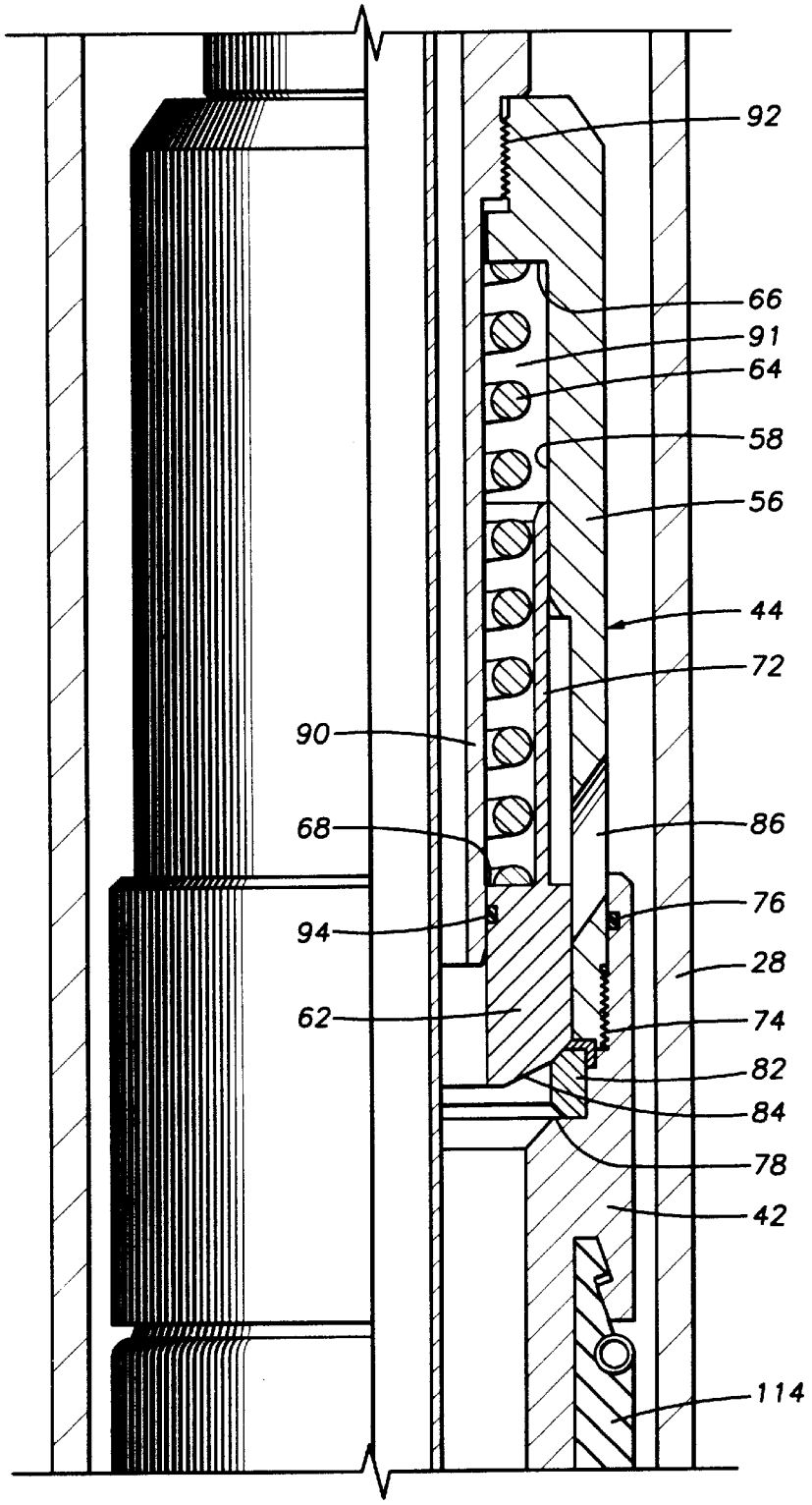
Figure 4C:
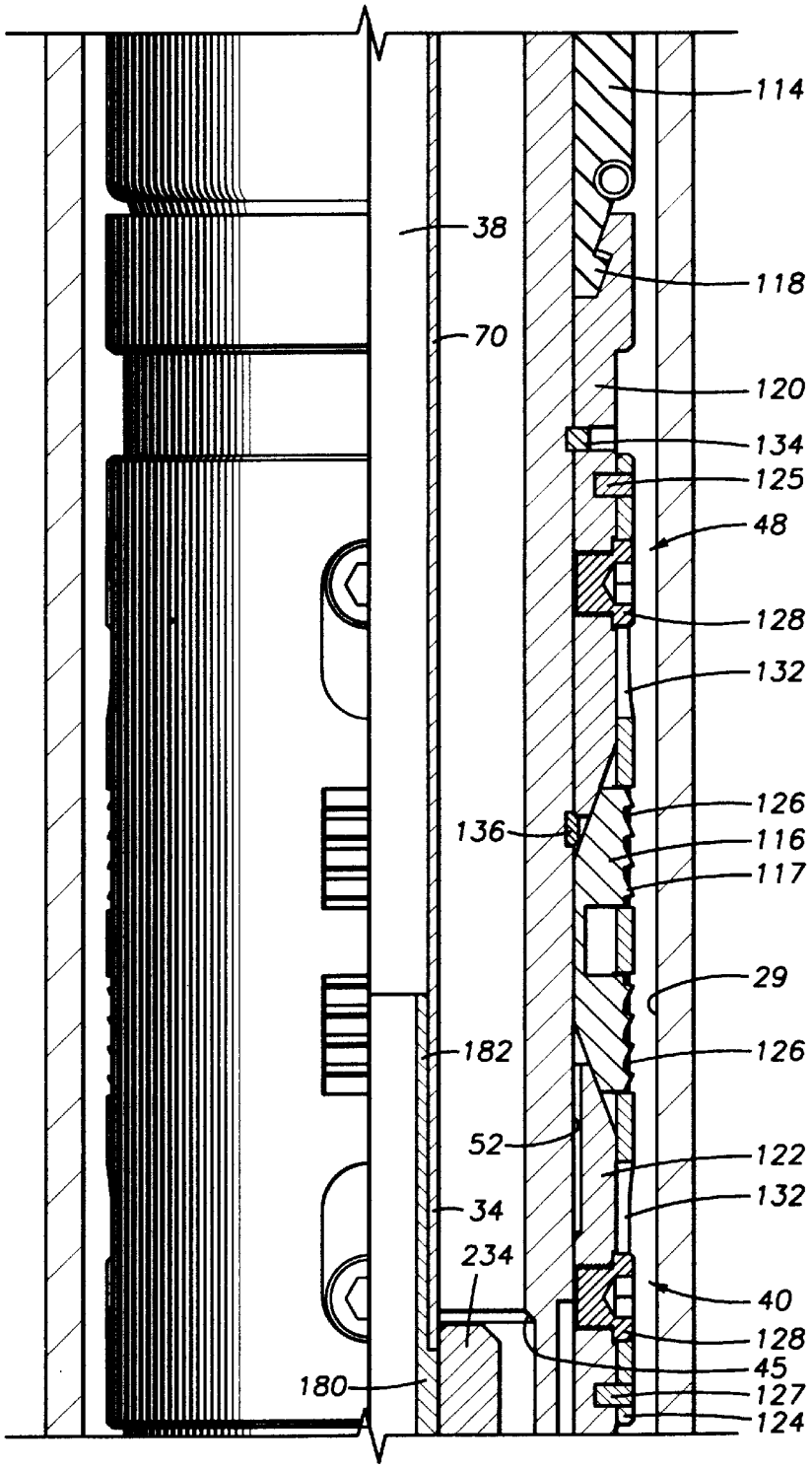
Figure 4D:
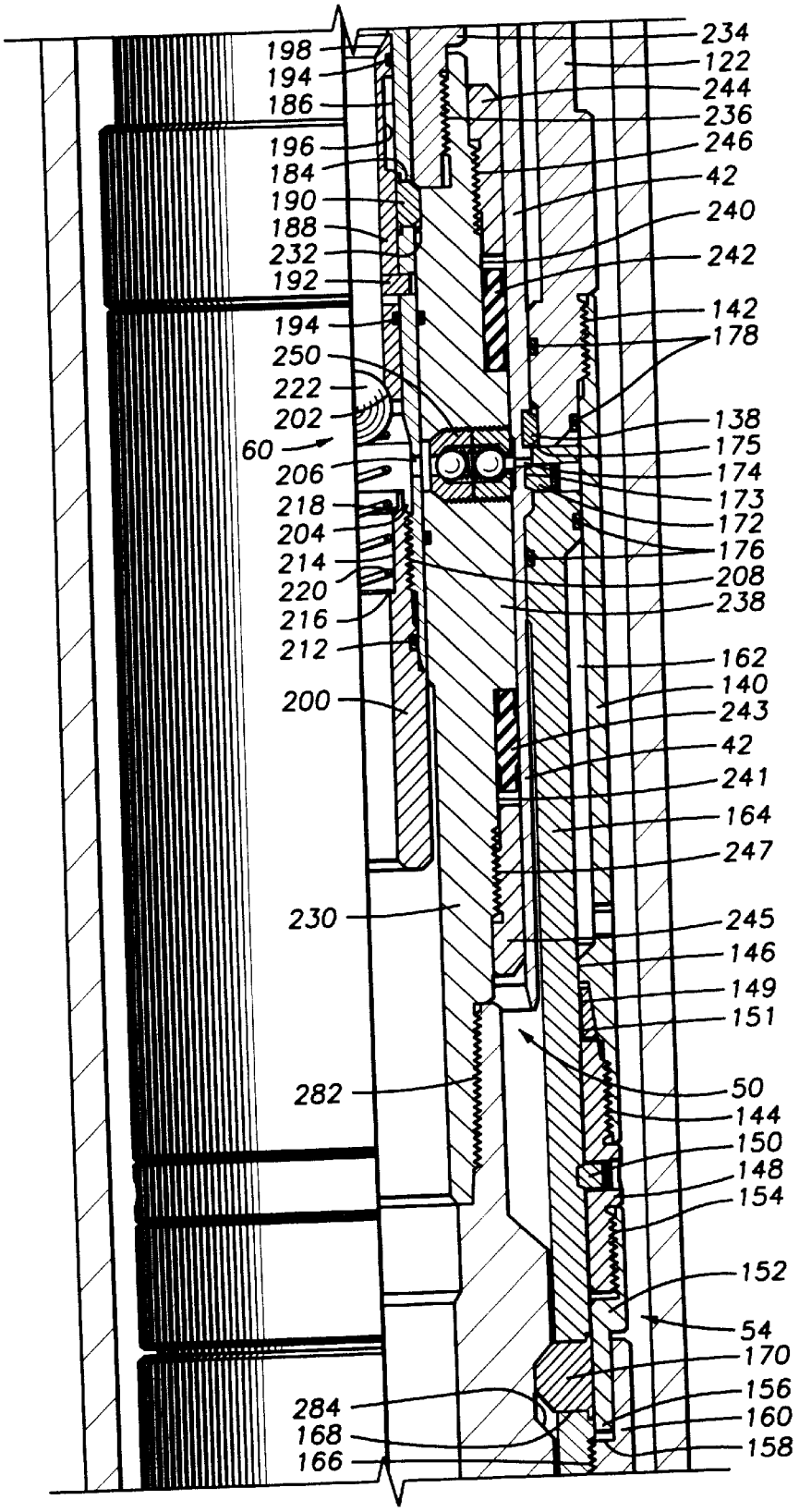

Continuing reference to FIG. 4 and particularly FIGS. 4C and 4D, triple valve 60 includes a valve housing 180 having a reduced outer diameter upper end 182 sized to be received within the lower end 34 of coiled tubing 70. The terminus of coiled tubing 70 abuts the annular shoulder formed by reduced diameter portion 182. The lower end 34 of coiled tubing 70 may be connected to valve housing 180 by various means such as by threaded engagement, by welding or by swedging of the coil tubing 70. Valve housing 180 includes a plurality of apertures 184 evenly spaced about its circumference for receiving dogs 190 which project radially outward of housing 180 in the running position shown in FIG. 4D. The inner annular surface of housing 180 includes a counterbore 186 for receiving annular sleeve 188. As shown in FIG. 4D, sleeve 188 in the running position biases dogs 190 radially outward. Sleeve 188 is held in position within housing 180 by a plurality of shear pins 192 extending between aligned bores in housing 180 and sleeve 188. Sleeve 188 is sealed with the inner circumferential surface of housing 180 by upper and lower seal members 194. A release groove 196 is disposed around the outer surface of sleeve 188 adjacent its upper end for receiving dogs 190 upon the shifting of sleeve 188 in the downward position, as discussed in more detail hereinafter. Sleeve 188 includes a tapered conical upper ball seat 198 at its upper terminal end and a tapered conical lower seat 202 at its lower terminal end. Valve housing 180, below sleeve 188, includes an enlarged diameter channel 204 having a plurality of hydraulic ports 206 evenly spaced around the circumference of valve housing 180. A retainer sleeve 200 is threaded to the lower end of valve housing 180 at 208. A seal 212 is disposed in an annular groove in sleeve 200 for sealingly engaging valve housing 180. Closing sleeve 200 includes an inner counterbore 214 forming an annular shoulder 216 for supporting one end of a coiled spring 220. A ball or sphere 222 is disposed within annular channel 204 for engagement with the upper end of spring 220. The upper terminal end of closing sleeve 200 forms a seat 218.

Figures 5A, 5B, 5C, 5D:
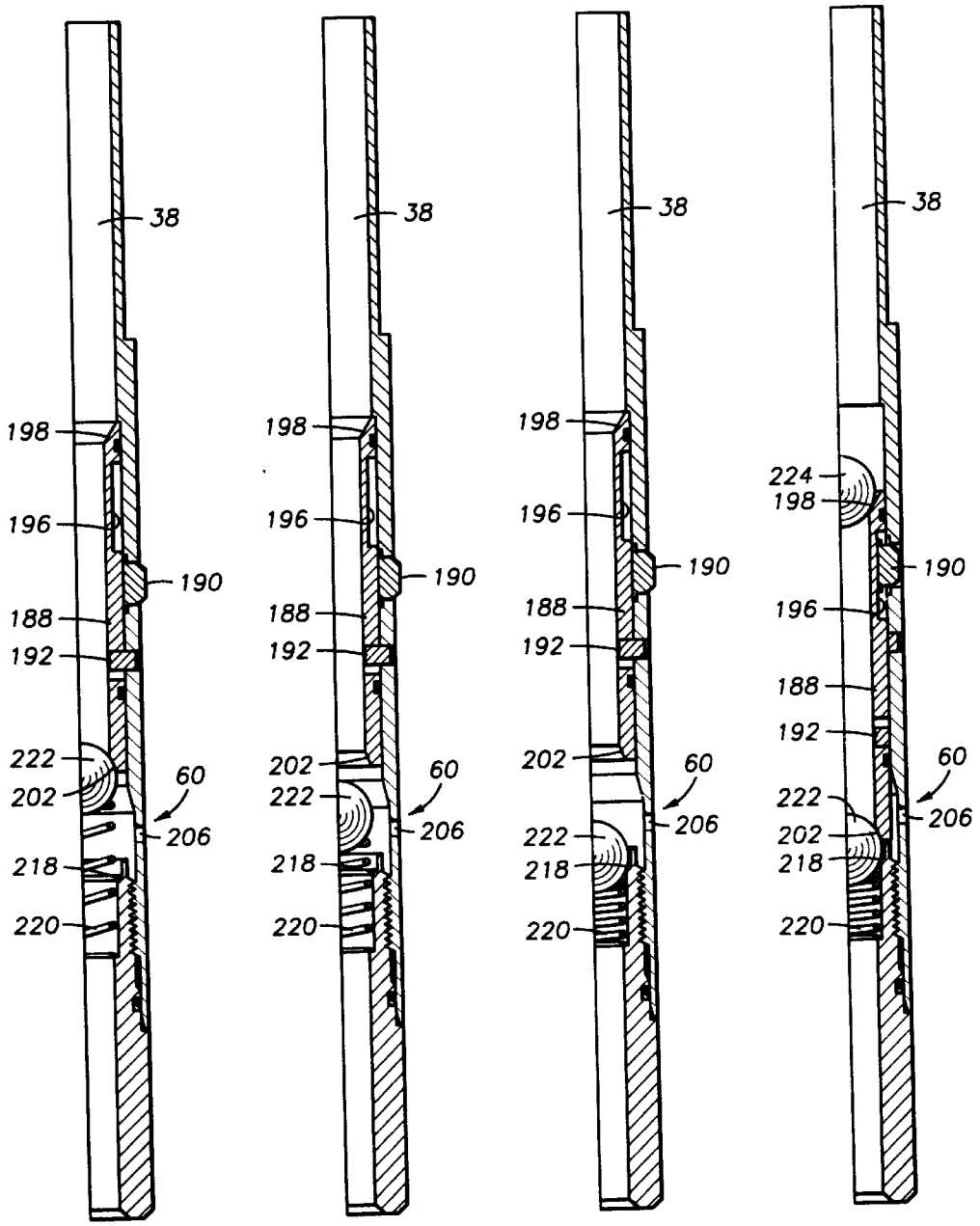
FIG. 5A is a partial cross-sectional view of the valve member of FIG. 4 in the back check position.
FIG. 5B is a partial cross-sectional view of the valve member of FIG. 4 in the velocity flow position.
FIG. 5C is a cross-sectional view of the valve of FIG. 4 in the up check position.
FIG. 5D is a partial cross-sectional view of the valve member of FIG. 4 in the emergency release position.

Referring now to FIGS. 5A, B, C and D, illustrating the various positions of triple valve 60, FIG. 5A illustrates triple valve 60 in its back check position. In the back check position, sphere 222 is seated in lower ball seat 202 of sleeve 188 by the force of compression spring 220. In the back check position, the force of spring 220 on sphere 222 is greater than the fluid pressure within flow bore 38 of coiled tubing 70 above sphere 222. In the back check position, sphere 222 seals with lower ball seat 202 to prevent the upward flow of fluids through triple valve 60 and into the flow bore 38 of coiled tubing 70. As shown in FIG. 5A, triple valve 60 operates as a back check valve.

Referring now to FIG. 5B, triple valve 60 operates as a velocity flow valve. In this position, fluids are pumped and flowed down flow bore 38 of coiled tubing 70 at a given range of flow rates. In that range, the fluid pressure on sphere 222 is sufficient to unseat sphere 222 from lower ball seat 202 and depress spring 220. However, such fluid flow is insufficient to place enough fluid pressure on sphere 222 to cause it to completely depress coiled spring 220 so as to seat in ball seat 218. Thus, in the velocity flow position, fluid may be circulated down the coiled tubing 70 and at or through the downhole tool assembly 80 and return up the lower annulus 35 between tubing 70 and casing 28, up the annulus 37 formed by tubing 70 and pack-off apparatus 40, through ports 86 in check valve 44, and up the upper annulus 36 between tubing 70 and casing 28 above pack-off apparatus 40 to the surface 12. In this position of triple valve 60, there may be circulation around downhole tool assembly 80. See FIGS. 8A–C.

Referring now to FIG. 5C, triple valve 60 also can operate as an up check valve. In the up check position, the fluid pressure from within the flow bore 38 of coiled tubing 70 is sufficiently great to fully depress spring 220 and cause sphere 222 to seat on ball seat 218. In this position, triple valve 60 is closed to the flow of fluid from the flow bore 38 above sphere 222.

Referring now to FIG. 5D, there is shown an emergency release position of triple valve 60. In this position, triple valve 60 may be disengaged from packer connector 50. A second sphere 224 is pumped down the flow bore 38 of coiled tubing 70 until it seats on upper ball seat 198. Fluid pressure above second sphere 224 is increased to a pressure which will overcome and shear pin 192 holding sleeve 188 in position so as to maintain dogs 190 in the radial and engaged position. Upon shearing shear pins 192, sleeve 188 shifts downward until the terminal ends of sleeve 188 and closing sleeve 200 engage. In such position, release grooves 196 are aligned with dogs 190 allowing dogs 190 to be cammed inwardly into release grooves 196 and out of engagement with packer connector 50.

Although triple valve 60 has been described in association with the coiled tubing apparatus of the present invention, it should be appreciated that triple valve 60 may be used in other applications. In particular, triple valve 60 may be used where a valve having three positions, namely a back check position, a velocity flow position, and an up check position, are required. The triple valve 60 further includes an emergency release position. The alternative uses of triple valve 60 may or may not require hydraulic port 206 in annular channel 204 and it should be appreciated and understood that the use of hydraulic port 206 depends upon the particular utilization of triple valve 60.

Packer Connector

Referring again to FIG. 4, packer connector 50 which supports downhole tool assembly 80 is connected on the lower end 34 of coiled tubing 70 by means of triple valve 60 and more particularly by the engagement of dogs 190 with packer connector 50. Packer connector 50 includes a connector body 230 having an inner annular groove 232 adjacent its upper end for receiving dogs 190. A retainer 234 is threaded at 236 into a counterbore in the upper end of packer connector body 230 to form the upper side of annular groove 232. Packer connector body 230 includes a central enlarged diameter portion 238 forming an upper counterbore 240 and a lower counterbore 241. Counterbores 240, 241 form an upwardly facing annular shoulder and a downwardly facing annular shoulder, respectively. Annular seal members 242, 243 are disposed in upper and lower counterbores 240, 241 and are maintained in position by upper and lower retainer rings 244, 245 threaded to the outer surface of packer connector 230 at 246, 247.

Figure 6:
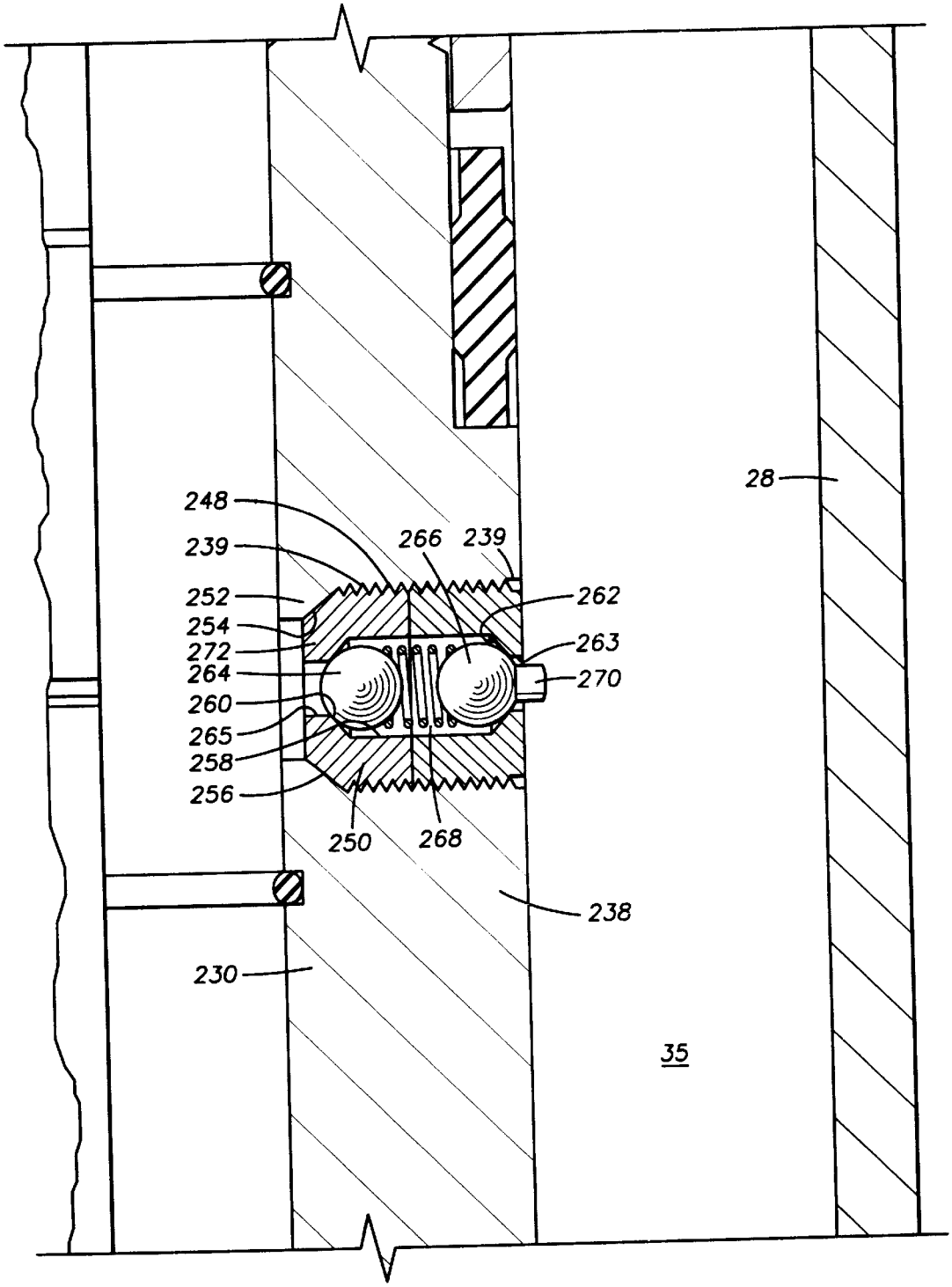
FIG. 6 is an enlarged cross-sectional view of the bi-directional check valve shown in FIG. 4.

Referring now to FIGS. 4 and 6, there is shown a bi-directional check valve 250 in the running position of FIG. 4 and in the disconnect position of FIG. 6. The central enlarged diameter portion 238 of packer connector body 230 includes an aperture 239 for receiving the bi-directional check valve 250. Aperture 239 includes a cylindrical threaded portion 248 and an inner restricted portion 252. Restricted portion 252 forms a conical seat 254. Bi-directional check valve 250 is generally cylindrical in shape having an outer threaded surface 246 for threadingly engaging threads 248 and a tapered conical surface 256 for sealing engagement with conical seat 254. The body of valve 250 may be split in two halves for assembly purposes. Bi-directional valve 250 includes an interior bore 258 therethrough having an tapered conical inner ball seat 260 and a tapered conical outer ball seat 262. First and second spheres 264, 266, respectively, are disposed within bore 258 with a coiled spring 268 disposed therebetween. Coiled spring 268 biases inner and outer spheres 264, 266 toward inner and outer ball seats 260, 262, respectively. Sphere 266 includes a projecting knob 270 which is aligned with the outer passageway 263 of bore 258 at outer seat 262. In the running position shown in FIG. 4, knob 270 bears against the inner cylindrical surface 43 of packer housing 42 thereby preventing outer sphere 266 from seating in outer ball seat 262. In this position, bi-directional check valve 250 operates as a one-way valve for fluid flowing from the inner passageway 265 of bore 258 at ball seat 262. Thus, flow is allowed from inner passageway 265 through outer passageway 263 but is prevented from outer passage 263 through passageway 265 so long as knob 270 engages housing 42. In the disconnect position of FIG. 6, the packer connector 50 has been disconnected from pack-off apparatus 40 and injected downhole. Thus, knob 270 no longer engages housing. 42 and sphere 266 is allowed to seat and prevent all flow through bi-directional valve 250.

Figure 4E:
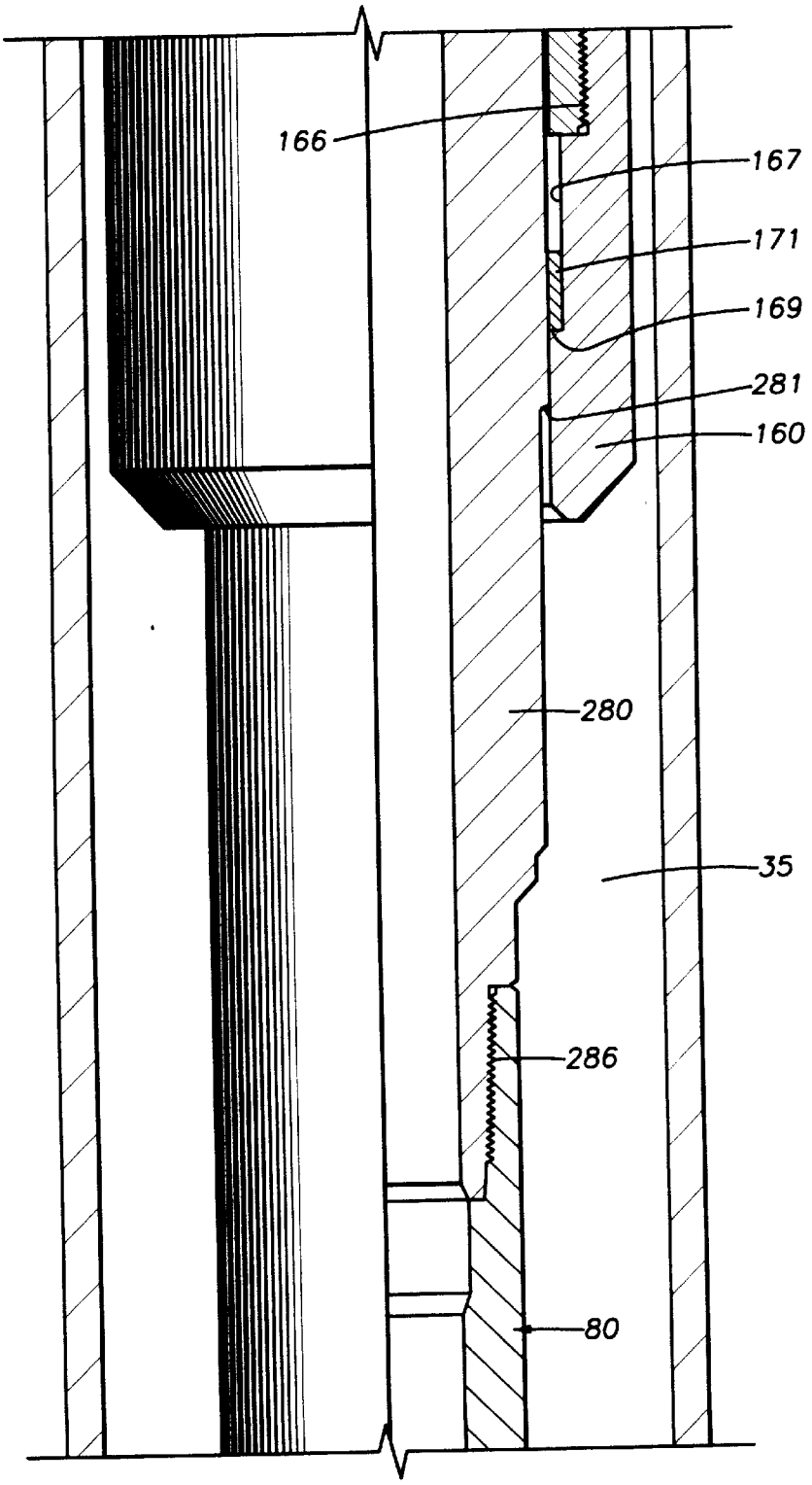

Referring again to FIG. 4 and particularly FIGS. 4D and 4E, a lower connector sub 280 is threadingly attached to the lower end of packer connector body 230 at threads 282. Connector sub 280 also includes an outer annular connector groove 284 which, in the running position, is aligned with dogs 170 from disconnect piston 164. Dog support sleeve 152 supports dogs 170 in their radial inward position through bores 168 in disconnect piston 164 such that dogs 170 project into annular groove 284 in connector sub 280. Connector sub 280 also includes an outer annular shoulder 281 for engagement with C-ring 171 during emergency disconnect described hereinafter in further detail. The downhole tool assembly 80 is threaded at 286 for connection with the lower end of connector sub 280.

In operation, FIG. 4 illustrates the tool of the present invention in the running position. Triple valve 60 is attached to the lower end 34 of coiled tubing 70. Dogs 190 on triple valve 60 are biased outwardly by sleeve 188 such that dogs 190 project into groove 232 of packer connector body 230 thus connecting the coiled tubing 70 and triple valve 60 to packer connector 50. The downhole tool assembly 80 is attached to the lower end of packer connector 50 by connector sub 280. Pack-off apparatus 40 is attached to packer connector 50 by dogs 170 projecting into annular groove 284 in connector sub 280. Dogs 170 are maintained in their radial inward position by dog support sleeve 152. In the running position, pack-off element 114 and slips 116 are in there innermost contracted position as shown in FIGS. 4B and 4C. Sleeve type check valve 44 is closed. Seal and scraper assembly 46 is in engagement with the outer circumferential surface of coiled tubing 70.

The coiled tubing apparatus of the present invention is injected downhole on the lower end 34 of coiled tubing 70 by injector 20. As the tool passes down the vertical portion 10 and then the radius portion 14 of the well, the coiled tubing 70 begins to drag on the inner circumferential wall of outer pipe string 28. As the force on injector 20 is increased to overcome the drag on coiled tubing 70, the drag increases until only an unacceptably small percentage of the injection force from the surface is being translated to the downhole tool assembly 80 at the lower end 34 of the coiled tubing 70.

Figure 7A:
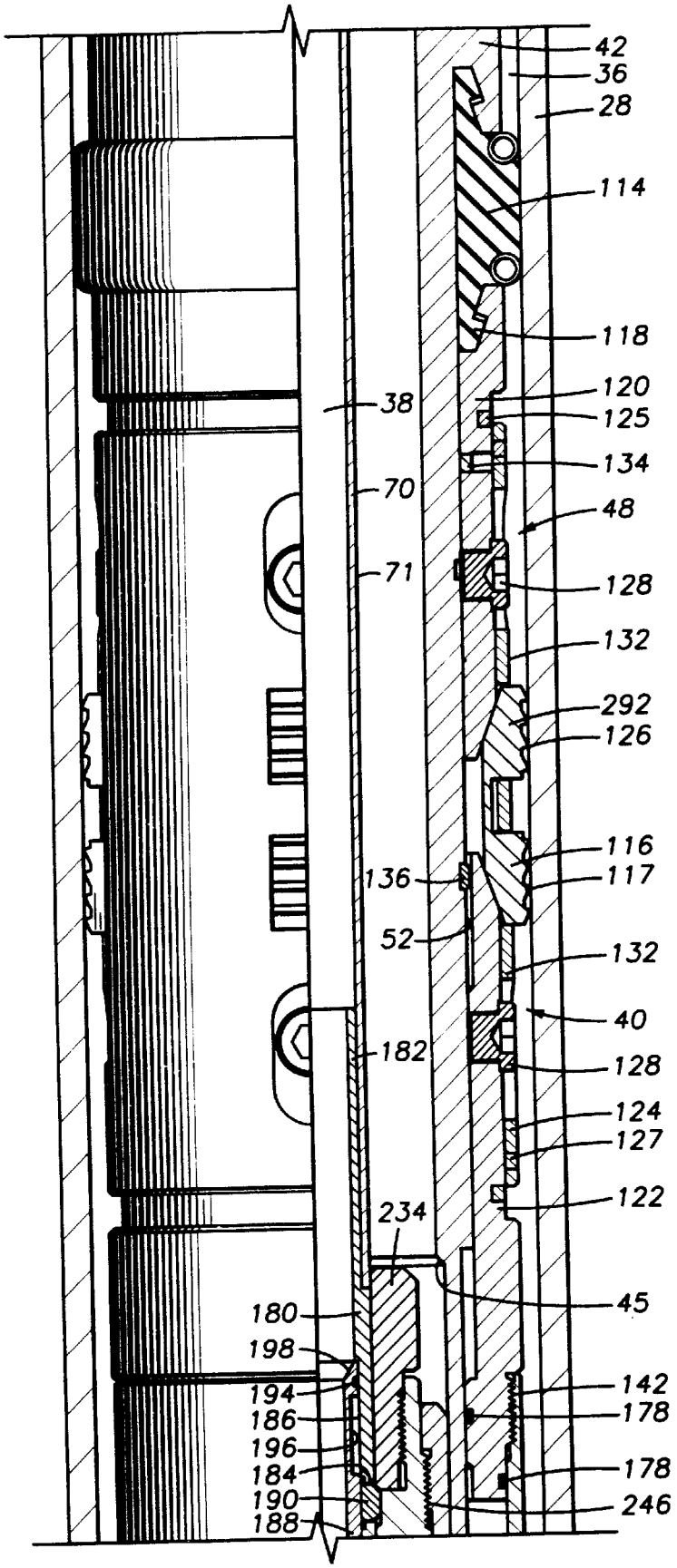
FIGS. 7A and 7B are a cross-sectional view of the pack-off apparatus shown in FIG. 4 disconnected from the packer connector and valve member.
Figure 7B:
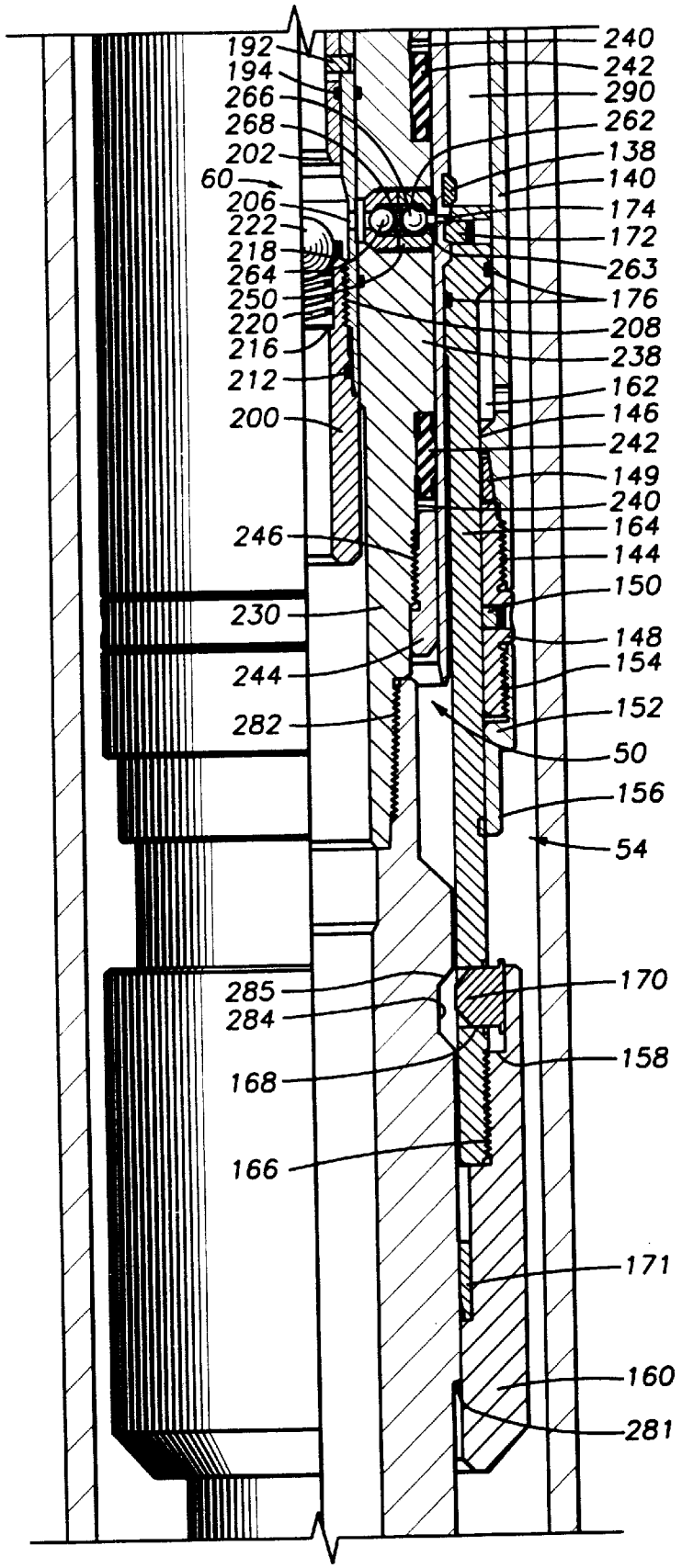

Referring now to FIGS. 7A and 7B, there is illustrated the setting of the pack-off apparatus 40 to assist in the injection of coiled tubing 70 into the well. To set pack-off apparatus 40, fluid flow, sufficient to force the sphere 222 against seat 218 to close the triple valve 60, is applied down the flow bore 38 of coiled tubing 70. Sphere 222 becomes seated on ball seat 218 thereby directing fluid pressure through hydraulic port 206. The fluid passing through hydraulic port 206 then applies fluid force on inner sphere 264 in bi-directional check valve 250 thereby depressing spring 268 and allowing fluid flow through the outer passageway 263 at outer seat 262. Fluid then passes through hydraulic port 174 and into chamber 290 formed between the terminal ends of lower packer wedge 122 and disconnect piston 164. The shear pins 172 maintain disconnect piston 164 in place while the fluid pressure first shears shear pin 150 to place the fluid pressure load on shear pins 134, 125 and 127 which shear to allow lower packer wedge 122 and upper packer wedge 120 to move upwardly. Shear pin 134 is sheared on or soon after shearing shear pin 150 to allow upper packer wedge 120 to move upwardly and compress packing element 114. The movement of upper packer wedge 120 compresses packing element 114 thereby expanding packing element 114 outwardly and into engagement with the inner circumferential wall 29 of outer pipe string 28. Upon sealing with pipe string 28, the fluid pressure shears upper shear pin 125, allowing upward movement of lower packer wedge 122. Lower shear pin 127 then shears causing wedges 120, 122 to cam slips 116 outward whereby the teeth 117 on slips 116 also engage the inner wall 29 of pipe string 28 to maintain packing element 114 in the radial outward and sealing position. Note that guide pins 128 allow window sleeve 132 to slide upwardly. The internal ratchet slips 149 bite on the outer surface of disconnect piston 164 and do not allow the downward movement of lower packer wedge 122, cylinder sleeve 140, shear pin sleeve 148, and dog support sleeve 152.

The setting of pack-off apparatus 40 simultaneously disconnects packer connector 50. Since sleeves 140, 148 and 152 are all connected to the end of lower packer wedge 122, the upper movement of wedge 122 moves sleeves 140, 148 and 152 with it. The result of such movement is that dog support sleeve 152 moves out of counterbore 158 allowing dogs 170 to be cammed inwardly by cam surface 285 in groove 284.

The setting of pack-off apparatus 40 closes annulus 36 since pack-off element 114 is now sealingly engaging the inner circumferential wall 29 of outer pipe string 28 and sealing rings 102, 104 of sealing and scraper assembly 46 are sealingly engaging the outer circumferential wall 71 of coiled tubing 70. As previously discussed, as fluid pressure is applied in annulus 36, the fluid pressure around coiled tubing 70 extending to the surface causes the tubing to centralize within outer pipe string 28 and to stiffen thereby more efficiently translating the injector force of injector 20 to the lower end 34 of coiled tubing 70.

Figure 8A:
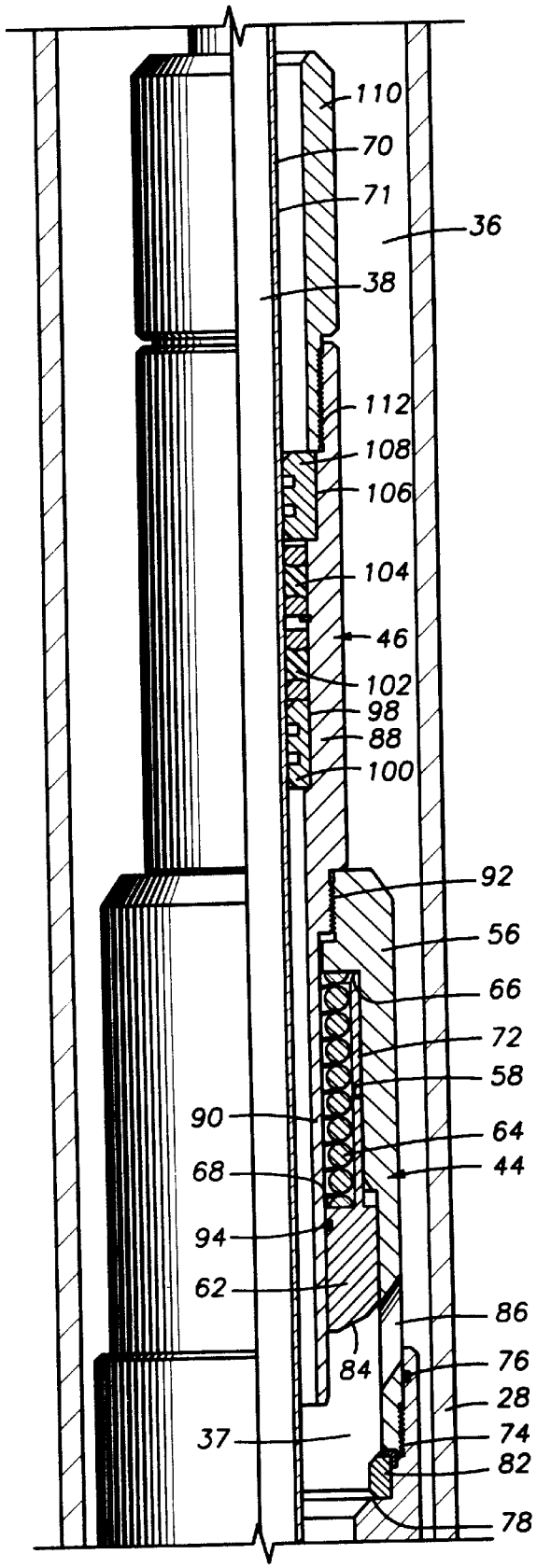
FIGS. 8A, B and C are a cross-sectional view of the pack-off apparatus with a hydraulic port opened in the pack-off apparatus for flowing the well after the downhole tool assembly has been injected further downhole.
Figure 8B:
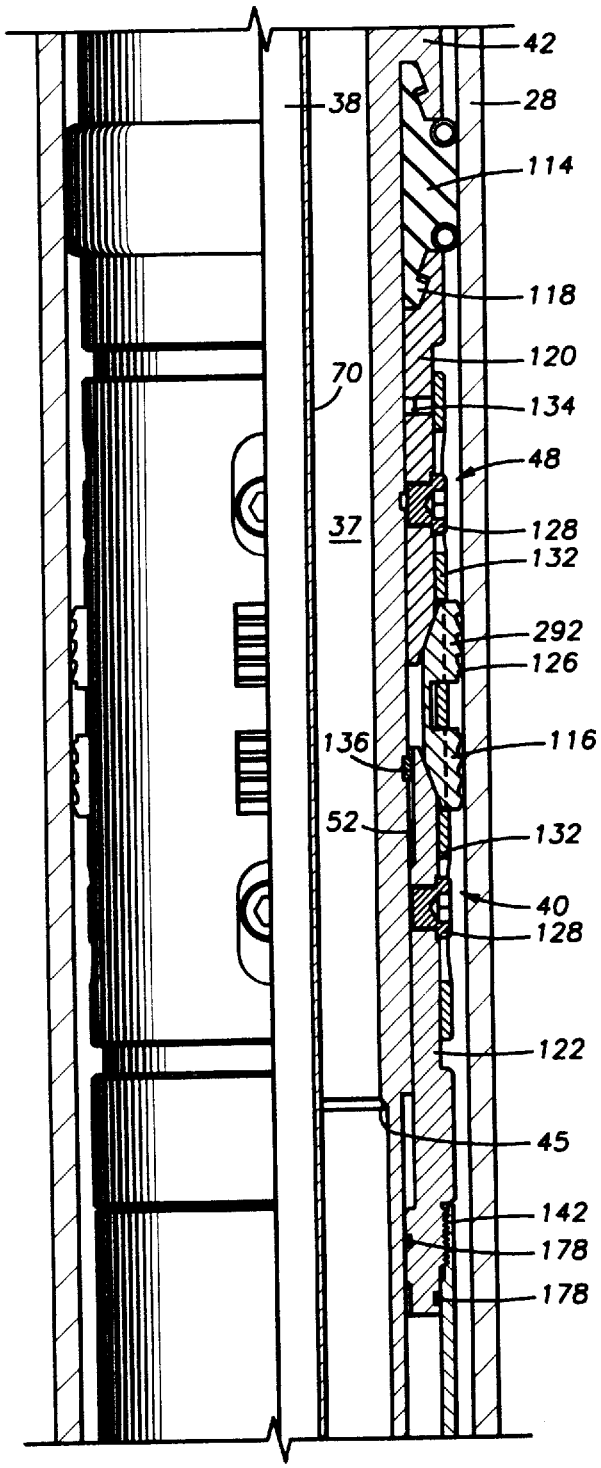
Figure 8C:
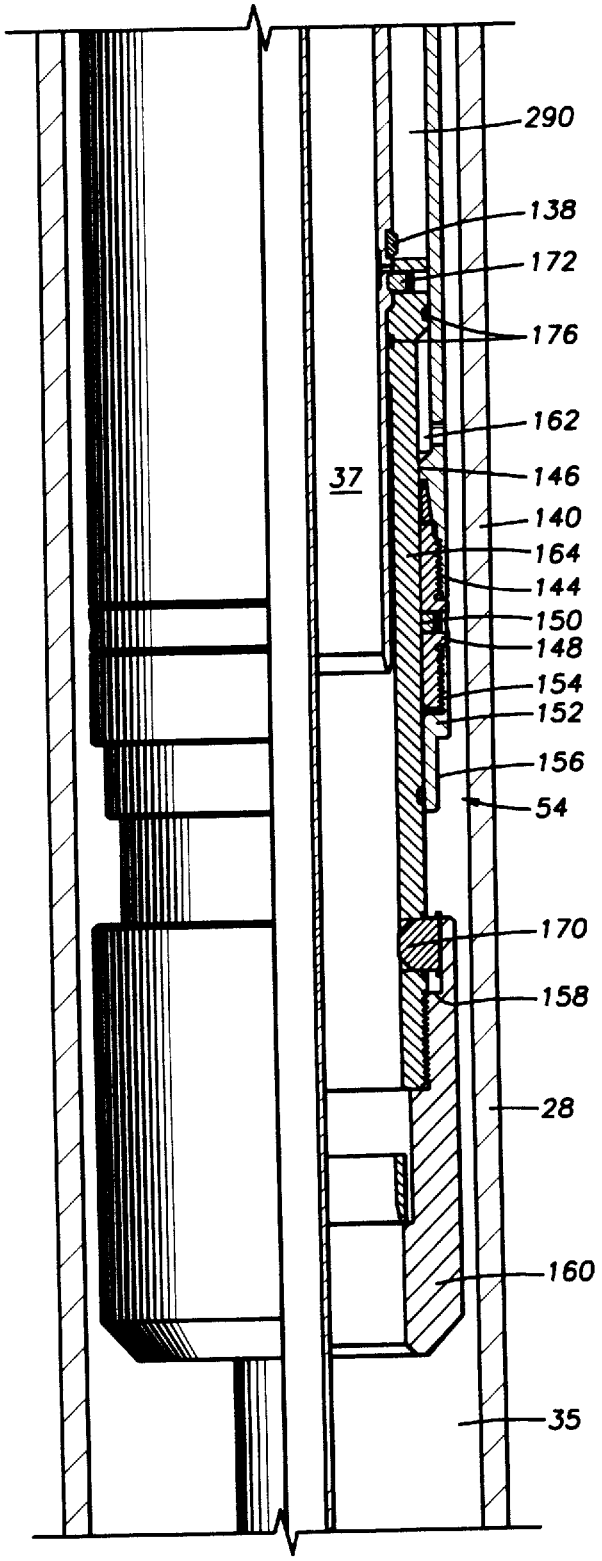

Referring now to FIGS. 8A, B, and C, the seal and scraper assembly 46 maintains a sliding seal with the outer cylindrical wall 71 of coiled tubing 70, and coiled tubing 70, with downhole tool assembly 80, is injected further into the horizontal portion 16 of the well. The pack-off apparatus 40 remains stationary at the point of its actuation within outer pipe string 28.

One use of the coiled tubing apparatus of the present invention is with a downhole tool assembly 80 which includes a downhole oilfield tool that requires fluid circulation. Thus, upon the downhole tool assembly 80 reaching its position downhole, well fluids pass downwardly through the flow bore 38 of coiled tubing 70 and through triple valve 60 in the velocity flow position of FIG. 5B. The fluids pass around the lower terminal end of coiled tubing 70 and upwardly through the lower annulus 35 formed between the coiled tubing 70 and outer pipe string 28 below pack-off apparatus 40. The fluid then passes into the annulus 37 between tubing 70 and pack-off apparatus 40. Because the seal and scraper assembly 46 is in sealing engagement with coiled tubing 70, no flow may pass between mandrel 88 of pack-off apparatus 40 and coiled tubing 70. Thus, upon the application of fluid pressure to the annular face 84 of valve sleeve 62, the spring force of spring 64 is overcome. As the hydraulic pressure overcomes the spring force, sleeve valve 62 retracts within counterbore 58 and opens hydraulic port 86 in annular valve housing 56. The opening of port 86 allows circulating fluid to pass from lower annulus 35 around pack-off apparatus 40 and into upper annulus 36 and up the surface 12.

Upon packer connector 50 passing downward to a location where bi-directional check valve 250 is no longer in engagement with housing 42 of pack-off assembly 40, knob 270 of outer sphere 266 no longer engages the inner circumferential wall of housing 42 as shown in FIG. 6. Without such engagement, outer sphere 266 becomes seated on outer ball seat 262 due to the spring force of spring 268. In this position, bi-directional check valve 250 prevents flow in either direction through bore 258, i.e., prevents fluid flow in either direction through packer connector body 230. This allows downhole circulation for downhole tool assembly 80.

Figure 9A:
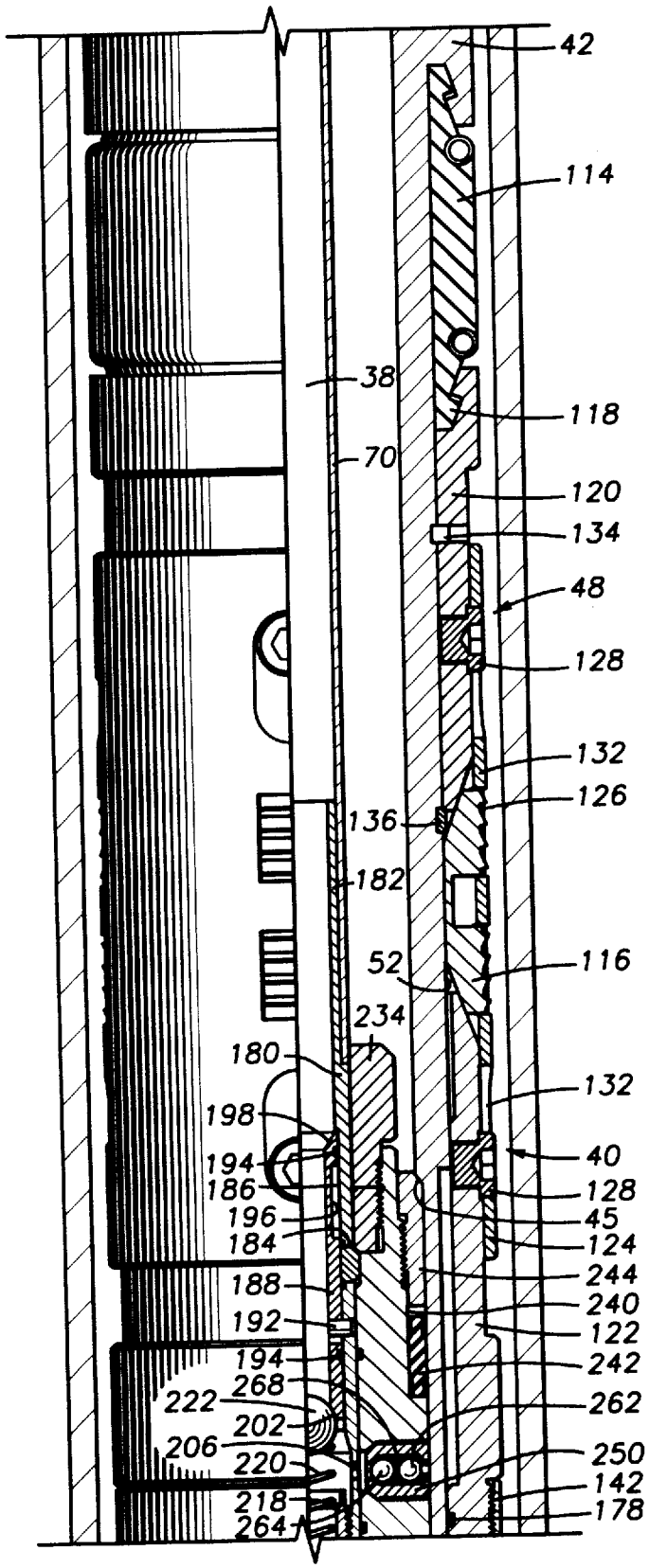
FIGS. 9A and 9B are a cross-sectional view of the packer connector and valve member having been retrieved up hole and received within the pack-off apparatus where the pack-off apparatus has been unset.
Figure 9B:
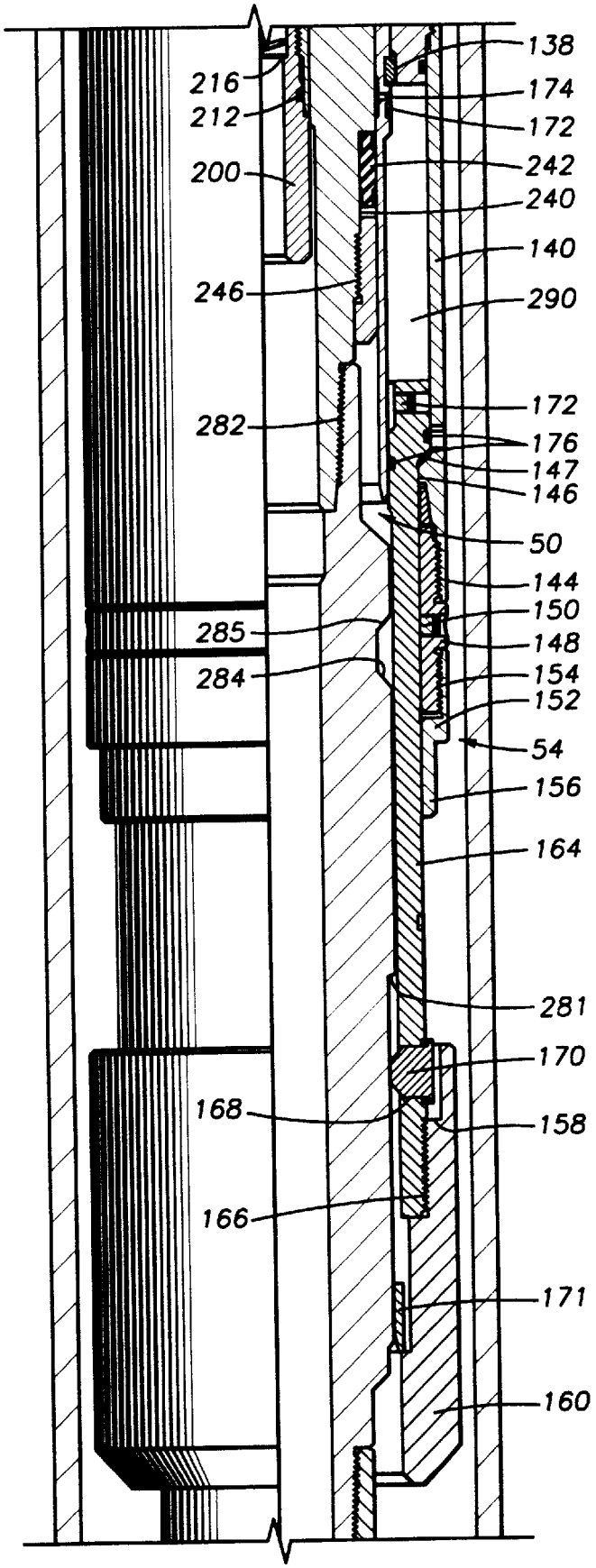

Referring now to FIG. 9, coiled tubing 70 is withdrawn from the borehole by injector 20. As packer connector 50, attached to the lower end 34 of coiled tubing 70, is received within housing 42 of pack-off apparatus 40, upper retainer ring 244 abuts downwardly facing conical shoulder 45 on housing 42. Knob 270 reengages housing 42 unseating outer sphere 266. Fluid pressure through the bore 38 of coiled tubing 70 overcomes the spring force of spring 220 in triple valve 60 and passes fluid pressure through hydraulic port 206, through bi-directional check valve 250 and through hydraulic port 174. With the annular area of disconnect piston 164 being larger than that of lower packer wedge 122, shear pins 172 are sheared thereby forcing disconnect piston 164 downwardly. Disconnect piston 164 shoulders at 147 against cylinder sleeve 40 causing dog support sleeve 152, shear pin sleeve 148, cylinder sleeve 140 and lower packer wedge 122 to move downwardly as a unit. The downward movement of disconnect piston 164 withdraws the cam surface of lower packer wedge 122 from slips 116 allowing slips 116 to contract into their nonengaging contracted position and upon further movement of disconnect piston 164, guide buttons 128 engage the limits of windows 132 so as to move upper packer wedge 120 downwardly thus elongating packer element 114 into a contracted and non-sealing position. Abutting snap ring 136 and abutment ring 138 support upper packer wedge 120 and lower packer wedge 122, respectively, to maintain wedges 120, 122 in an upper position and prevent them from falling down around housing 42 during the unsetting operation. Thus, pack-off apparatus 40 has been unset and may be withdrawn from the borehole.

Figure 10A:
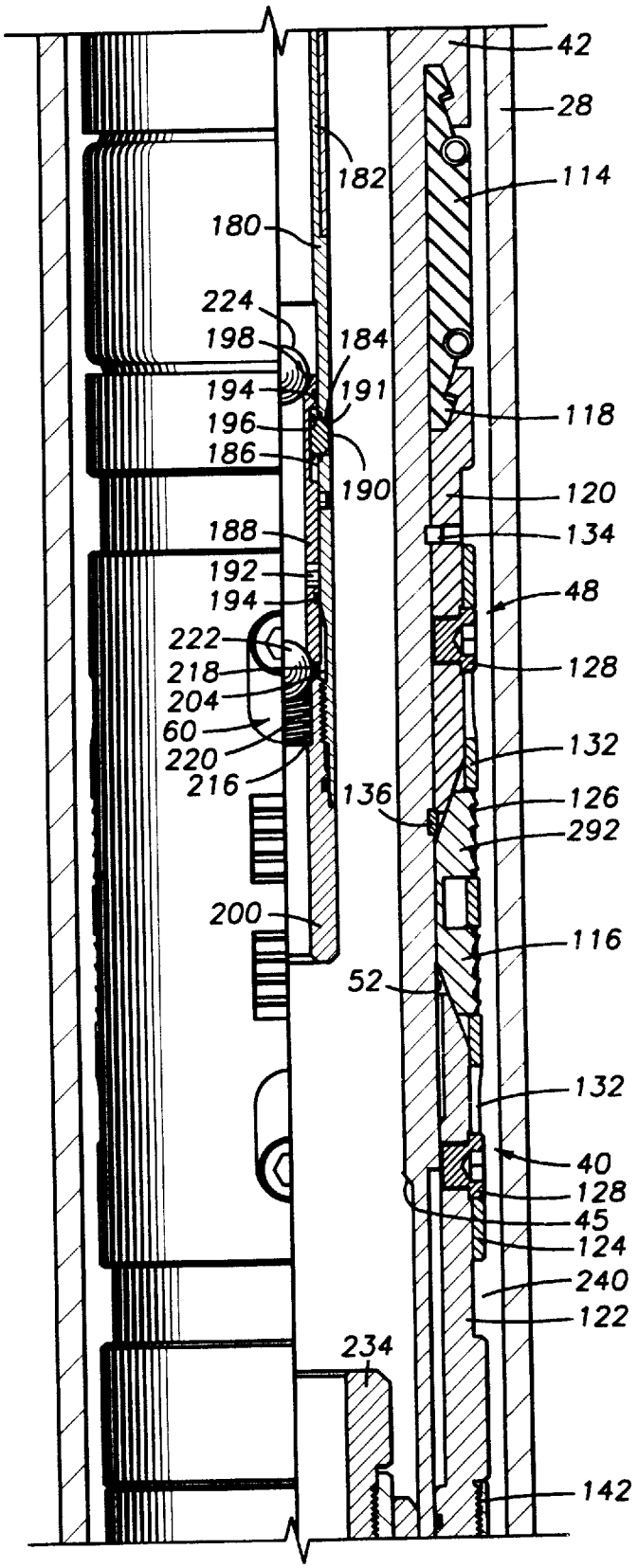
FIGS. 10A and 10B are a cross-sectional view of the valve member in the emergency disconnect position from the packer connector.
Figure 10B:
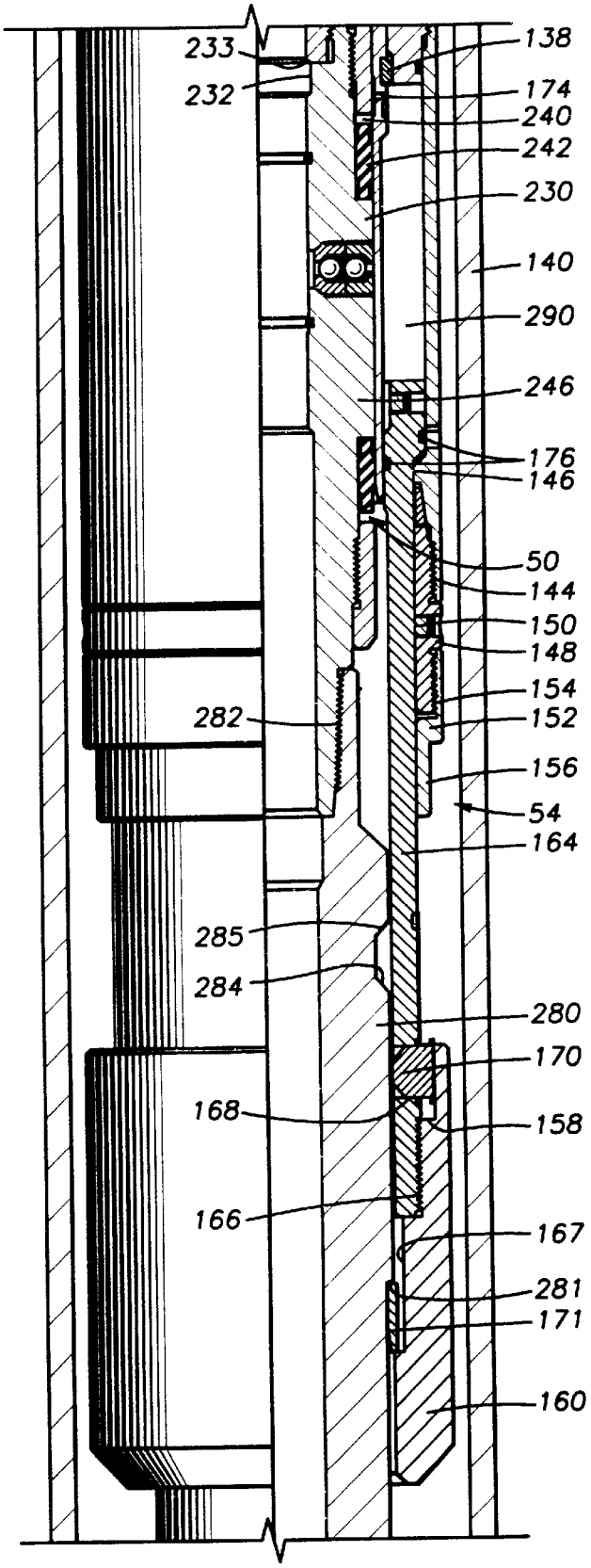

Referring now to FIG. 10, if the pack-off apparatus 40 cannot be unset and released, the present invention provides a safety release of the coiled tubing 70 from packer connector 50. Since coiled tubing 70 has a limit as to the amount of tension that may be applied for the purpose of unseating pack-off apparatus 40, coiled tubing 70 is released from packer connector 50 so that a fishing string (not shown) may then be lowered and connected to fishing neck 110 to unseat and remove pack-off apparatus 40.

To release the lower end 34 of coiled tubing 70 from packer connector 50, a second sphere 224 is passed down coiled tubing 70 and seated on upper ball seat 198. See FIG. 5D. Fluid pressure is increased above sphere 224 until shear pins 192 are overcome and sheared. Upon shearing pin 192, sleeve 188 moves downwardly until the terminal end of sleeve 188 engages the terminal end of sleeve 200. In this position, release groove 196 is in alignment with dogs 190 allowing dogs 190 to contract radially inward and disengage from groove 232 of packer connector body 230. Dogs 190 have a cam surface 191 which cams with the upper annular edge 233 of groove 232 to move inwardly and disengage triple valve 60 from packer connector 50. Such disengagement allows coiled tubing 70 and triple valve 60 to be removed from the borehole leaving packer connector 50, downhole tool assembly 80, and pack-off apparatus 40 in place downhole.

Upon disengaging and removing coiled tubing 70 and triple valve 60 from the borehole, packer connector body 230 is no longer supported by triple valve 60 and coiled tubing 70 within the borehole. Further, dog support sleeve 152 has been moved upwardly and therefore no longer supports dogs 170 in the engaged position with packer connector 50. Dogs 170 will be in their radial outward position. This causes packer connector to move downwardly within pack-off apparatus 40 such that annular shoulder 281 seats on the upper terminal end of C-ring 171. C-ring 171 prevents packer connector 50 from remaining downhole upon the fishing and retrieving of pack-off apparatus 40. A fishing string (not shown) engages fishing neck 110 and pulls or jars to unseat pack-off apparatus 40. C-ring 171 maintains the pack-off apparatus 40, packer connector 50, and downhole tool assembly 80 as one unit so that it may be retrieved in one trip of the fishing string into the borehole. The pulling and jarring of the fishing string shears pin 172 to unseat the pack-off apparatus 40 as previously described with respect to the use of fluid pressure for unsetting pack-off apparatus 40.

Referring now to FIGS. 11A–D, there is shown an alternative preferred embodiment of the apparatus and method of the present invention for use with an E-line (electric line) downhole tool assembly 290 such as a logging tool. The alternative preferred embodiment shown in FIG. 11 is for use with a downhole tool assembly which does not require fluid circulation and utilizes substantially the same pack-off apparatus 40 as the embodiment shown in FIGS. 4–10. However, this alternative preferred embodiment has modifications to the sleeve type check valve, seal and scraper assembly, packer connector and utilizes a different valve assembly. Where elements of the alternative preferred embodiment are substantially the same as those of the preferred embodiment of FIGS. 4–10, the same reference numerals will be used.

The preferred embodiment of FIG. 11 includes a pack-off apparatus 280, a packer connector 350, and a cable head 330, all initially disposed on the lower end 34 of coil tubing 70. The alternative preferred embodiment is shown in the running position in FIG. 11 with a downhole tool assembly 290 disposed on the lower end of cable head 330. The pack-off apparatus 280 is substantially the same as pack-off apparatus 40 shown in the preferred embodiment of FIGS. 4–10. The pack-off apparatus 280 includes certain variations in the sleeve type check valve 282 and the seal and scraper assembly 284.

The sleeve type check valve 282 includes an annular valve housing 56 having an inner counterbore 58 for housing a valve sleeve 286 biased downwardly by a spring 64 disposed between a downwardly facing shoulder 66 on valve housing 56 and the upwardly facing annular end 288 of valve sleeve 286. The upper end of housing 42 includes a counterbore 78 housing an annular valve seat 292. A sealing member 293 is provided for sealing between housing 42 and valve seat 292.

Seal and scraper assembly 284 includes a mandrel 88 threadingly connected to valve housing 56 by threads 92. Mandrel 88 includes a downwardly extending annular skirt 90 which forms an annular cylinder 91 with valve housing 56 within which is disposed valve sleeve 286 and spring 64. A relief port 294 is provided into chamber 91 through housing 56 to allow fluid flow in and out of cylinder 91 during the reciprocation of sleeve 286 within major counterbore 295. The lower end of valve sleeve 286 has a conically tapered surface 84 for sealingly engaging the upper tapered end of valve seat 292.

The mandrel 88 of seal and scraper assembly 284 also includes an internal counterbore 98 housing upper and lower scraper rings 100, 108, respectively, with a pair of seal rings 102, 104 disposed therebetween. A backup ring 296 is also disposed within counterbore 98 for maintaining seal rings 102, 104 in sealing engagement with the outer surface 71 of tubing 70 and includes an inwardly projecting annular shoulder for separating rings 102, 104. Shear screws 103 are provided through the wall of the upper end of mandrel 88 and received within an outer annular groove in upper scraper ring 108 to maintain the assembly within counterbore 98. Shear screws 103 shear upon emergency disconnect as hereinafter described.

In the embodiment of FIG. 4, the triple valve 60 was connected to the lower end 34 of coiled tubing 70 with the packer connector 50 connected to triple valve 60 and supporting downhole tool assembly 80. In the embodiment of FIG. 11, the cable head 330 is connected to the lower end 34 of coiled tubing 70 and supports the downhole tool assembly 290 such as an E-line logging tool (not shown). An electrical cable 340 is connected, as hereinafter described, to cable head 330 and extends through the flow bore 38 of coiled tubing 70 to the surface 12. The cable head 330 may include any conventional apparatus for connecting electrical cable to a downhole logging tool and in particular, the cable head 330 is preferably the Coiled Tubing Logging Cable Head manufactured by Halliburton. Since the Coiled Tubing Logging Cable Head is shown as cable head 330 and is a conventional cable head, cable head 330 will only be summarily described with respect to the coiled tubing apparatus of the present invention.

The cable head 330 includes a one-way check valve 300 connected to the lower end 34 of coiled tubing 70. Check valve 300 includes a housing 302 having an upper box end 308 threaded at 305 to an adapter 303. Adapter 303 includes a reduced diameter terminal end 304 sized to be received within the lower end 34 of coiled tubing 70. The terminus of coiled tubing 70 abuts an outer annular shoulder formed by reduced diameter end 304. The lower end 34 of coiled tubing 70 may be connected to adapter 303 by various means which are well known in the art. For example, the coiled tubing 70 may be rolled and crimped at 307 around adapter 303. Adapter 303 includes annular grooves housing seal members 306 for sealing engagement with coiled tubing 70. Valve housing 302 includes a plurality of inclined apertures 312 passing through the wall of housing 302. Each inclined aperture 312 includes a ball seat 314, a sphere 310 disposed within aperture 312 and a compression spring 316 biasing sphere 310 against seat 314. The spring 316 and sphere 310 are maintained within aperture 312 by a snap ring 318. A series of inner and outer threads 324 are provided on the lower inner circumferential wall of housing 302 for threadingly engaging cable head 330.

The cable head 330 includes a connection assembly 342 mounted within a bore in the lower end of housing 302. An elastomeric gland is compressed around cable 340 and a plurality of slips 349 are cammed into engagement with cable 340 for the attachment of cable 340 to cable head 330. The armor around the lower end 345 of electrical cable 340 is removed to expose a plurality of wires 347, typically seven (7) in number, which extend through extended housing 351, which is threaded at 324 to housing 302 and connection assembly 342. Electrical connections are made at 353, as is well known in the art, with a wire 355 extending to a connection 357 at the lower end of cable head 330. The electrical connection 357 connects cable head 330 to downhole tool assembly 290 such as a logging tool.

Cable head 330 includes an emergency disconnect assembly 332. Emergency disconnect assembly 332 includes an inner disconnect sub 334 and an outer disconnect sub 336. Inner disconnect sub 334 includes an outwardly facing connect groove 338 and an upwardly projecting connector skirt 340 having a fish neck 344 at its terminal end. Connector skirt 340 includes a plurality of outer connector grooves 342. Outer connector sub 336 includes a plurality of inwardly opening grooves 346 and windows (not shown) for installing and receiving shear wires 348 adapted for being received within both grooves 342 and grooves 346. Pins 359 are provided to prevent rotation between subs 334 and 336.

Packer connector 350 includes a connector body 352 having an enlarged diameter portion 354 forming an upper counterbore 356 and a lower counterbore 358. Counterbores 356 and 358 form an upwardly facing annular shoulder and a downwardly facing annular shoulder, respectively. Annular seal members 360, 361 are disposed in upper and lower counterbores 356, 358 and are maintained in position by upper and lower retainer rings 362, 364 which are threaded to the outer surface of packer connector body 352. Seal members 360, 361 sealingly engage the outer circumference of packer connector body 352 and the inner circumferential wall of housing 42 of pack-off apparatus 40. Packer connector body 354 also includes upper and lower inner counterbores 366, 368 for receiving seal members 367, 369 with upper seal member 368 sealing between packer connector body 352 and valve housing 302 and lower seal member 369 sealing between packer connector body 352 and the outer circumferential wall of cable assembly 330. Enlarged diameter portion 354 of body 352 includes a passageway 372 extending through the wall of packer connector body 352.

Packer connector 350 further includes a lower connector sub 374 threadingly connected at 376 to the lower terminal end of packer connector body 352. The upper terminal end of lower connector sub 374 retains seal member 369 within lower counterbore 368. Adjacent the upper end of bore connector sub 374 is disposed annular connect groove 378 for receiving dogs 170 on pack-off apparatus 40. A connector ring 380 is threaded at 383 to the lower terminal end of lower connector sub 374. Connector ring 380 has an inner upwardly facing annular shoulder 385 supporting half segments 382 held together by an elastic member such as an O-ring 387. Half segments 382 have inwardly projecting accurate portions 384 which are received in annular groove 338 in inner disconnect sub 334. Half segments 352 provide the connection between packer connector 350 and cable head 330.

In operation, FIG. 11 illustrates this preferred embodiment of the present invention with an E-line assembly in the running position. The lower end 34 of coiled tubing 70 with cable head 330 is connected to packer connector 350 by half segments 382 being extended radially inward into connector groove 338 on cable head 330 by connector ring 380. Packer connector 350 is connected to pack-off apparatus 40 by dogs 170 being received within connector groove 378 in the lower connector sub 374 of packer connector 350.

The cable head 330 and downhole tool assembly 290 are injected downhole on the end 34 of coiled tubing 70 by injector 20. As the downhole tool assembly 290 passes down the vertical portion 10 and then the radius portion 14 of the well, the coiled tubing 70 begins to drag on the inner circumferential wall of outer pipe string 28. As the force of injector 20 is increased to overcome the drag on coiled tubing 70, there is an indication that the pack-off apparatus 280 needs to be set.

Pack-off apparatus 280 is set similarly to that of the preferred embodiment of FIGS. 4–10. Fluid pressure is applied down flow bore 38 of coiled tubing 70. Since cable head 330 does not provide for flow through the lower end of coiled tubing 70, the fluid pressure is directed through one-way check valve 300 and in particular fluid pressure passes through aperture 312 as ball 310 is unseated due to the fluid pressure being greater than the biasing force of coil spring 316. Fluid pressure then passes through hydraulic port 312 and hydraulic port 372 in packer connector body 352. The fluid pressure then passes through port 174 and causes the shear pins to be sheared allowing the pack-off apparatus 280 to be set as previously described with respect to the preferred embodiment of FIGS. 4–10.

As with the preferred embodiment of FIGS. 4–10, the setting of pack-off apparatus 280 simultaneously disconnects packer connector 350. The movement of lower packer wedge 122 causes dog support sleeve 152 to move out of counterbore 158 allowing dogs 170 to be cammed inwardly by cam surface 379 of groove 378.

The setting of pack-off apparatus 280 closes annulus 36 since pack-off element 114 is now sealingly engaging the inner circumferential wall 29 of outer pipe string 28 and sealing members 102, 104 of sealing and scraper assembly 46 are sealingly engaging the outer circumferential wall 71 of coiled tubing 70. As previously discussed, as fluid pressure is applied in annulus 36, the coiled tubing 70 extending to the surface 12 tends to centralize within outer pipe string 28 and to stiffen thereby more efficiently translating the injector force of injector 20 to the downhole tool assembly 330 on the lower end of coiled tubing 70.

Since the seal and scraper assembly 284 maintains a sliding seal with the outer cylindrical wall 71 of coiled tubing 70, coiled tubing 70 is injected further into the horizontal portion 16 of the well. The pack-off apparatus 280 remains stationary at the point it was set within outer pipe string 28. The cable head 330 does not allow circulation through the downhole tool assembly 290. However, fluids can pass through one-way check valve 330 and up the lower annulus 37 formed between coiled tubing 70 and outer pipe string 28 below packer apparatus 280. Because the seal and scraper assembly 284 is in sealing engagement with coiled tubing 70, no fluid may pass between mandrel 88 and coiled tubing 70. Thus, upon the application of hydraulic pressure, the annular face 84 of sleeve valve 286 overcomes the spring force of spring 64. Upon retracting sleeve valve 286, port 86 is open so as to allow circulating fluid to pass from the lower annulus 37 into the upper annulus 36.

Upon withdrawing coiled tubing 70 from the borehole by injector 20, packer connector 350 is received within housing 42 of pack-off apparatus 280 until upper retainer ring 362 engages downwardly facing conical shoulder 45 on housing 42. Fluid pressure is then applied through flow bore 38 of coiled tubing 70 and through one-way check valve 300 to move disconnect piston 164 downwardly thereby shearing pins 172 and releasing slips 116 and packing element 114 as previously described.

Figure 12A:
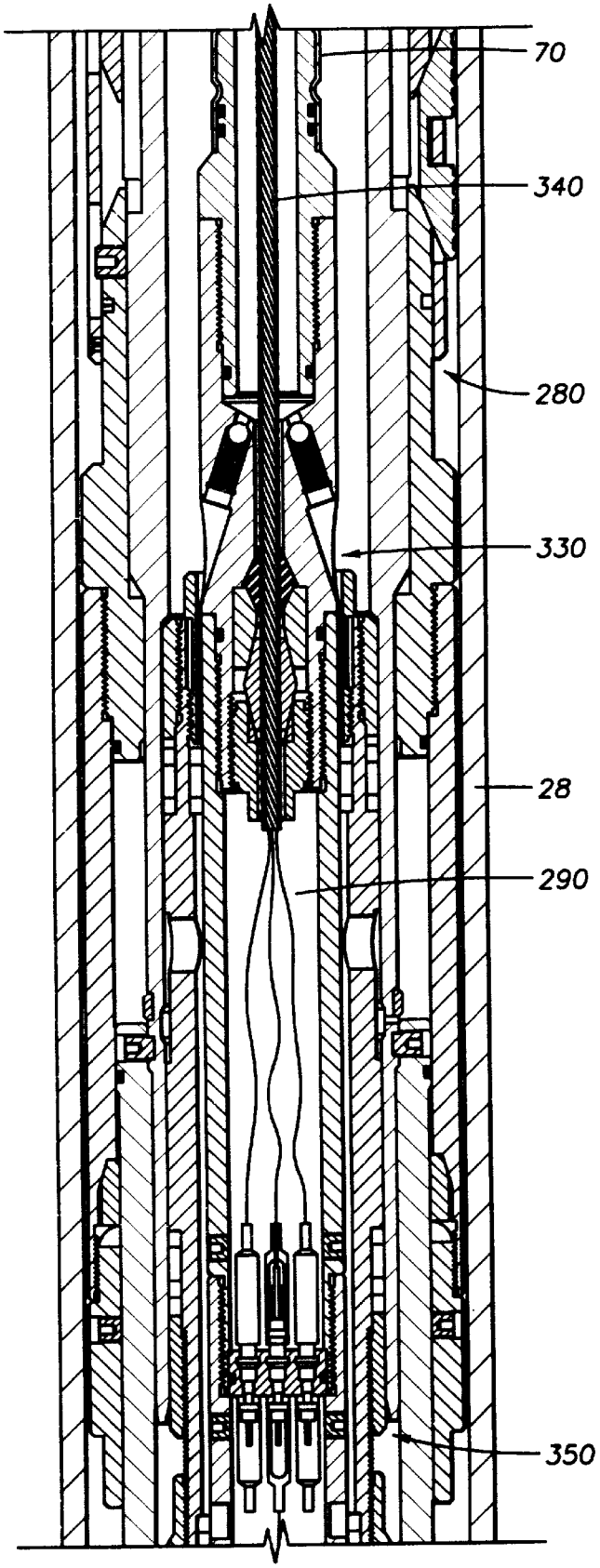
FIGS. 12A and 12B are a cross-sectional view of an emergency disconnect of the valve member of FIG. 11 from the packer connector and pack-off apparatus.
Figure 12B:
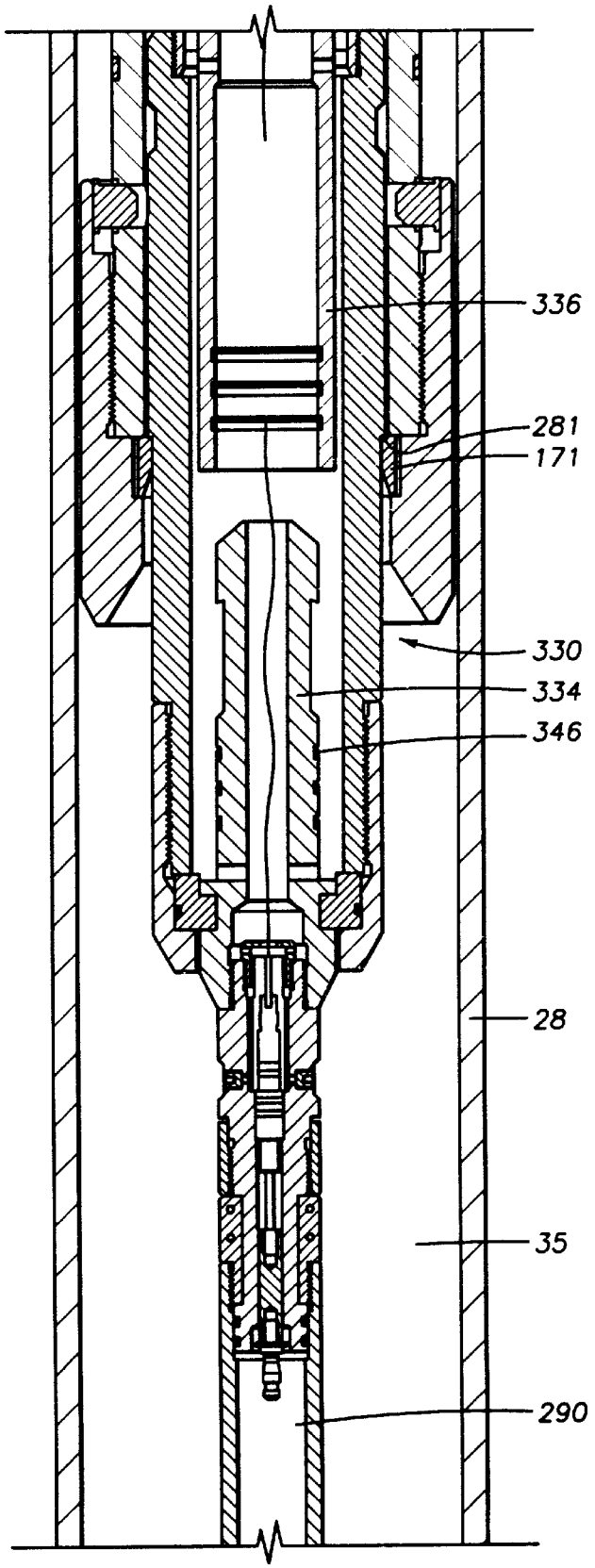

Referring now to FIG. 12, if the pack-off apparatus 280 cannot be unset and released, a safety release is provided on downhole tool assembly 330. Tension is applied to coiled tubing 70 until shear wires 348 shear within grooves 342 and 346. To pass cable head 330 through mandrel 88, the upper end of cable head 330 engages lower scraper 100 so as to shear shear screws 103 thereby releasing scrapers 100, 108 and seals 102, 104. After coiled tubing 70 has been withdrawn, a fishing string (not shown) may be lowered to connect onto mandrel 88 to unseat and remove pack-off apparatus 280.

While a preferred embodiment of the invention has been shown and described, modifications thereof can be made by one skilled in the art without departing from the spirit of the invention.

We claim:

1. An apparatus for lowering a downhole tool on a coiled tubing through an outer pipe string, comprising:

a connector member disposed on the coiled tubing;

a pack-off member releasably connected to said connector member and adapted for sealingly engaging the outer pipe string;

said connector member and pack-off member lowered into the outer pipe string together with the downhole tool; and said pack-off member receiving the coiled tubing therethrough and sealingly engaging the exterior surface of the coiled tubing for pressurizing the annulus between the coiled tubing and outer pipe string above said pack-off member.

2. The apparatus of claim 1 further including a disconnect for disconnecting said connector member from the coiled tubing.

3. An apparatus for lowering a downhole tool on a coiled tubing through an outer pipe string, comprising:

a connector member disposed on the coiled tubing;

a pack-off member releasably connected to said connector member and adapted for sealingly engaging the outer pipe string;

said connector member and pack-off member lowered into the outer pipe string together with the downhole tool;

said pack-off member sealingly engaging the coiled tubing for pressurizing the annulus between the coiled tubing and outer pipe string above said pack-off member;

a disconnect for disconnecting said connector member from the coiled tubing; and a retainer on said pack-off member for retaining said connector member on said pack-off member after disconnecting the coiled tubing from said connector member.

4. An apparatus for lowering a downhole tool on a coiled tubing through an outer pipe string, comprising:

a connector member disposed on the coiled tubing;

a pack-off member releasably connected to said connector member and adapted for sealingly engaging the outer pipe string;

said connector member and pack-off member lowered into the outer pipe string together with the downhole tool;

said pack-off member sealingly engaging the coiled tubing for pressurizing the annulus between the coiled tubing and outer pipe string above said pack-off member;

an electric cable head disposed on said connector member for electrical attachment to the downhole tool.

5. The apparatus of claim 4 wherein said pack-off apparatus includes a valve for flowing well fluids between said annulus above said pack-off member and the annulus between the coiled tubing and outer pipe string below said pack-off member after said connector member is disconnected from said pack-off member.

6. An apparatus for lowering a downhole tool on a coiled tubing through an outer pipe string, comprising:

a connector member disposed on the coiled tubing;

a pack-off member releasably connected to said connector member and adapted for sealingly engaging the outer pipe string;

said connector member and pack-off member lowered into the outer pipe string together with the downhole tool;

said pack-off member sealingly engaging the coiled tubing for pressurizing the annulus between the coiled tubing and outer pipe string above said pack-off member; and said connector member including a valve for flowing fluids down the coiled tubing and through the downhole tool and wherein said pack-off member includes a valve for returning the fluids between said connector member and pack-off member and up said annulus.

7. A system for injecting coiled tubing downhole through an outer pipe string with an injector applying a force to the coiled tubing and a pressurized fluid source for applying fluid pressure downhole, the improvement comprising:

a closure member for closing the flowbore of the coiled tubing to fluid flow;

a valve member disposed adjacent the end of the coiled tubing for opening a port to fluid flow;

a pack-off member having a packer element with expanded and contracted positions and an actuator member for actuating said packer element to said expanded position;

a connector member for releasably connecting said valve member to said pack-off member and having a fluid passageway communicating said port with said actuator member;

said pack-off member having a release member for releasing said connector member upon the actuation of said actuator member and a seal member to sealingly engage the coiled tubing;

fluid pressure being applied through the coiled tubing and said port to actuate said actuator member and move said packer element to said expanded position in sealing engagement with the outer pipe string such that said packer element and seal member pack off the annulus formed by the coiled tubing and outer pipe string;

the actuation of said actuator member causing said release member to release said connector member and thus disconnect the end of the coiled tubing from said pack-off member; and fluid pressure applied down the annulus for stiffening the coiled tubing for further injecting the coiled tubing downhole.

8. The system of claim 7 wherein said valve member includes a valve body having a side wall in which is disposed said port forming an aperture through said side wall and a check valve disposed in said port allowing fluid to pass outward through said port.

9. The system of claim 7 wherein said valve member includes a body having a flowbore therethrough and said closure member closes said flowbore.

10. The system of claim 9 wherein said closure member includes a ball biased by a spring member against the fluid pressure and said valve body includes a seat for said ball to close said flowbore upon the fluid pressure causing said ball to overcome said bias and seal with said seat.

11. The system of claim 7 wherein said connector member includes an aperture for receiving said valve member and an opening aligned with said port.

12. The system of claim 11 wherein said connector member includes a check valve disposed in said opening allowing fluid to pass outwardly through said opening.

13. The system of claim 11 wherein said pack-off member includes a housing and said actuator member is slidably mounted on said housing, said housing having a bore through a wall of said housing in communication with said opening, one end of said actuator member being exposed to said bore whereby said actuator member may slide on said housing by the application of fluid pressure through said bore.

14. The system of claim 13 wherein said release member is connected to said actuator member and releases said connector member upon said sliding movement of said actuator member.

15. The system of claim 14 wherein said connector member includes a housing with an annular groove around said housing, said release member including a projecting member projecting from said pack-off member and into said annular groove to connect said pack-off member to said connector member.

16. The system of claim 15 wherein said release member includes a support member slidably mounted on said pack-off member and engaging said projecting member to support said projecting member into said annular groove.

17. The system of claim 16 wherein said actuator member slidably moves said support member to a non-supporting position to release said pack-off member from said connector member.

18. The system of claim 13 wherein said pack-off member includes a disconnect member disposed on said housing for moving said pack-off element to said contracted position.

19. The system of claim 18 wherein said disconnect member is exposed to said bore, said disconnect member having another end having a greater pressure area than said one end of said actuator member, said disconnect member having a shear member attaching said disconnect member to said housing, whereby upon the application of fluid pressure sufficient to shear said shear member, said disconnect member moving said actuator member to move said packer element to said contracted position.

20. The system of claim 7 wherein said pack-off member includes a housing having a wall with a circulating port and a valve for opening and closing said circulating port.

21. The system of claim 20 wherein said valve includes a sleeve biased to a closed position by a spacing member whereby said sleeve moves to a position upon the application of a fluid pressure greater than the bias of said spring member.

22. The system of claim 7 wherein said seal member includes a scraper member adapted for engaging the coiled tubing.

23. The system of claim 7 wherein said valve member includes a release sleeve maintaining a latch member into a groove in said connector member for connecting said valve member to said connector member.

24. The system of claim 23 further including a release member for moving said release sleeve to a position where said release sleeve no longer maintains said latch member in said groove and said valve member is released from said connector member.

25. A method for injecting coiled tubing into a cased borehole comprising the steps of:

injecting into the cased borehole a pack-off apparatus and tool assembly mounted on the coiled tubing;

setting the pack-off apparatus within the cased borehole to assist the injection of the tool assembly;

disconnecting the pack-off apparatus from the coiled tubing;

pressurizing the annulus around the coiled tubing; and injecting the coiled tubing and tool assembly further into the cased borehole.

26. The method of claim 25 further including the step of circulating fluid around the coiled tubing at the tool assembly.

27. The method of claim 25 further including the step of disconnecting the pack-off apparatus upon setting the pack-off apparatus.

28. The method of claim 25 further including the step of disconnecting the coiled tubing from the tool assembly.

29. A method for injecting coiled tubing into a cased borehole comprising the steps of:

injecting into the cased borehole a pack-off apparatus and tool assembly mounted on the coiled tubing;

setting the pack-off apparatus within the cased borehole to assist the injection of the tool assembly;

disconnecting the pack-off apparatus from the coiled tubing;

pressurizing the annulus around the coiled tubing;

injecting the tool assembly further into the cased borehole; and passing fluid through a valve member attached to the coiled tubing for setting the pack-off apparatus.

30. A method for injecting coiled tubing into a cased borehole comprising the steps of:

injecting into the cased borehole a pack-off apparatus and tool assembly mounted on the coiled tubing;

setting the pack-off apparatus within the cased borehole to assist the injection of the tool assembly;

disconnecting the pack-off apparatus from the coiled tubing;

pressurizing the annulus around the coiled tubing;

injecting the coiled tubing and tool assembly further into the cased borehole;

disconnecting the pack-off apparatus upon setting the pack-off apparatus; and flowing well fluids up the annulus below the pack-off apparatus, through a valve in the pack-off apparatus, and up the annulus above the pack-off apparatus.

31. A method for injecting coiled tubing into a cased borehole comprising the steps of:

injecting into the cased borehole a pack-off apparatus and tool assembly mounted on the coiled tubing;

setting the pack-off apparatus within the cased borehole to assist the injection of the tool assembly;

disconnecting the pack-off apparatus from the coiled tubing;

pressurizing the annulus around the coiled tubing;

injecting the coiled tubing and tool assembly further into the cased borehole;

setting the pack-off apparatus at a first fluid pressure in the coiled tubing;

circulating fluid down to the tool assembly at a second fluid pressure in the coiled tubing; and closing the coiled tubing to fluid flow at a third fluid pressure in the coiled tubing.

32. An apparatus for lowering a downhole tool on a coiled tubing through an outer pipe string, comprising:

a connector member disposed on the coiled tubing;

a pack-off member releasably connected to said connector member and adapted for sealingly engaging the outer pipe string;

said connector member and pack-off member lowered into the outer pipe string together with the downhole tool;

said pack-off member sealingly engaging the coiled tubing for pressurizing the annulus between the coiled tubing and outer pipe string above said pack-off member; and said pack-off member including a sealing assembly which sealing engages the coiled tubing, said sealing assembly being releasably disposed on said pack-off member whereby said sealing assembly is released upon disconnecting said connector member from the coiled tubing.

* * * * *